US008538316B2

(12) United States Patent
Shigeno et al.

(10) Patent No.: US 8,538,316 B2
(45) Date of Patent: Sep. 17, 2013

(54) PRINTING APPARATUS AND DECURLING DEVICE

(75) Inventors: Kenji Shigeno, Yokohama (JP); Tetsuhiro Nitta, Yokohama (JP); Masato Izumi, Kawasaki (JP); Ryosuke Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 320 days.

(21) Appl. No.: 12/949,659

(22) Filed: Nov. 18, 2010

(65) Prior Publication Data

US 2011/0211890 A1 Sep. 1, 2011

(30) Foreign Application Priority Data

Feb. 26, 2010 (JP) ..... 2010-042342
May 13, 2010 (JP) ..... 2010-111537

(51) Int. Cl.

| | |
|---|---|
| ***B65H 23/34*** | (2006.01) |
| ***B65H 23/32*** | (2006.01) |
| ***B65H 85/00*** | (2006.01) |
| ***G03G 15/00*** | (2006.01) |
| ***B41J 3/60*** | (2006.01) |

(52) U.S. Cl.
USPC ..... 399/406; 399/401; 399/402; 347/104; 400/188; 400/642; 271/188; 271/209

(58) Field of Classification Search
USPC ..... 399/406, 401, 402; 271/188, 209; 347/104; 400/188, 642
See application file for complete search history.

(56) References Cited

U.S. PATENT DOCUMENTS

| | | | | |
|---|---|---|---|---|
| 3,658,642 | A * | 4/1972 | Keyes et al. | 162/197 |
| 5,572,308 | A * | 11/1996 | Suda et al. | 399/401 |
| 5,637,070 | A * | 6/1997 | Sasai | 493/321 |
| 6,415,130 | B1 * | 7/2002 | Fujiwara et al. | 399/401 |
| 7,914,215 | B2 * | 3/2011 | Tomatsu et al. | 400/625 |
| 2005/0063747 | A1 * | 3/2005 | Ushio | 399/406 |
| 2006/0040093 | A1 * | 2/2006 | Tani | 428/195.1 |
| 2007/0092322 | A1 * | 4/2007 | Tomatsu | 399/406 |
| 2007/0110490 | A1 * | 5/2007 | Tateishi | 399/406 |
| 2008/0247796 | A1 * | 10/2008 | Johnston et al. | 399/406 |
| 2009/0129839 | A1 * | 5/2009 | Yamazaki et al. | 399/400 |

FOREIGN PATENT DOCUMENTS

| | | | |
|---|---|---|---|
| JP | 61-028754 | U | 2/1986 |
| JP | 61060554 | A * | 3/1986 |
| JP | 01267254 | A * | 10/1989 |
| JP | 03227875 | A * | 10/1991 |
| JP | 07056474 | A * | 3/1995 |
| JP | 08-012162 | A | 1/1996 |
| JP | 10-310305 | A | 11/1998 |
| JP | 11199142 | A * | 7/1999 |
| JP | 11-228005 | A | 8/1999 |
| JP | 2000044100 | A * | 2/2000 |

(Continued)

*Primary Examiner* — Daniel J Colilla
*Assistant Examiner* — Nguyen Q Ha
(74) *Attorney, Agent, or Firm* — Canon USA, Inc., IP Division

(57) ABSTRACT

With front face printing, the sheet fed from a sheet feeding unit is led into a nipped position between a first pinch roller and a decurling roller from a first direction, and is discharged by decurling force being applied thereto at the decurling roller. On the other hand, the sheet fed from a reverse unit is led into the nipped position from a second direction opposite to the first direction, and is discharged by decurling force being applied thereto at the decurling roller.

21 Claims, 17 Drawing Sheets

(56) References Cited

FOREIGN PATENT DOCUMENTS

| | | | | |
|---|---|---|---|---|
| JP | 2001-337564 | A | | 12/2001 |
| JP | 2005-258251 | A | | 9/2005 |
| JP | 2008-126530 | A | | 6/2008 |
| JP | 2009-166944 | A | | 7/2009 |
| JP | 2009190799 | A | * | 8/2009 |

* cited by examiner

PRINTING APPARATUS AND DECURLING DEVICE

BACKGROUND OF THE INVENTION

1. Field of the Invention

The present invention relates to a printing apparatus configured to subject a sheet to printing.

2. Description of the Related Art

With Japanese Patent Laid-Open No. 2008-126530, a printing apparatus has been disclosed, which uses a long continuous sheet wound in a rolled state to perform duplex printing on both sides of the sheet by the inkjet method.

SUMMARY OF THE INVENTION

A sheet wound in a rolled state has curling (a tendency to curl remains). When the sheet still having curling is fed to a print unit, there is a concern that the leading edge of the sheet will come into contact with a print head. Therefore, before the sheet is printed at the print unit, it is desired to perform decurling (curl correction) as to the sheet being paid out off of a roll.

With the device according to Japanese Patent Laid-Open No. 2008-126530, at the time of duplex printing, after printing as to the front face of a sheet, the sheet is temporarily taken up on a reel, the sides of the sheet are reversed, and printing is performed. Curling is also newly applied in the direction of taking up at the time of a sheet being taken up on this reel. Accordingly, it is desired to perform decurling not only before printing of the front face but also before the back face by the sheet being reversed. This is a new issue with duplex printing. However, with the device according to Japanese Patent Laid-Open No. 2008-126530, nothing is considered regarding decurling.

The present invention has been made based on the recognition of the above issue. The present invention provides a printing apparatus capable of performing curl correction using a decurling mechanism common to each of front face printing and back face printing of duplex printing. The present invention also provides a compact decurling device capable of performing curl correction as to a sheet to be led from a different direction.

According to an aspect of the present invention, there is provided a printing apparatus capable of duplex printing, including: a sheet feeding unit configured to hold and feed a sheet wound in a rolled state; a decurling unit configured to correct curling of a sheet to be fed from the sheet feeding unit; a print unit configured to subject a sheet passed through the decurling unit to printing; and a reverse unit configured to wind the sheet printed at the print unit around, and to reverse both sides of the sheet; with the decurling unit including a decurling roller, a first pinch roller, and a second pinch roller and a third pinch roller on both sides of the first pinch roller, which are each disposed around the decurling roller, and are capable of forming a nipped state with the decurling roller; with the sheet fed from the sheet feeding unit being led into a nip position between the first pinch roller and the decurling roller from a first direction, and the sheet led from the first direction being nipped with the decurling roller in order of the first pinch roller, and the second pinch roller, and being fed to the print unit; and with the sheet fed from the reverse unit being led into a nip position between the first pinch roller and the decurling roller from a second direction opposite to the first direction, and the sheet led from the second direction being nipped with the decurling roller in order of the first pinch roller and the third pinch roller, and being fed to the print unit.

According to the present invention, a compact printing apparatus capable of performing curl correction using a decurling mechanism common to front face printing and back face printing of duplex printing is realized. Also, a compact decurling device capable of performing curling correction as to a sheet to be led from a different direction is realized.

Further features of the present invention will become apparent from the following description of exemplary embodiments with reference to the attached drawings.

DESCRIPTION OF THE EMBODIMENTS

Hereafter, embodiments of a printing apparatus using the inkjet method will be described. The printing apparatus of the present embodiment is a high-speed line printer which can handle both of simplex printing and duplex printing using a long continuous sheet (long continuous sheet longer than the length of repetition print units (also called one page or unit image) in the conveying direction). For example, this printing apparatus is adapted to a field for a great number of sheets in a print lab or the like. Note that, with the present Specification, even when multiple small images, letters, or blanks are mixed in a one print unit (one page) region, all included in this region are referred to as one unit image. That is to say, a unit image means one print unit (one page) in the event of successively printing multiple pages on a continuous sheet. The length of a unit image differs according to an image size to be printed. For example, with a photo of L size, the length in the sheet conveying direction is 135 mm, and with A4 size, the length in the sheet conveying direction is 297 mm.

The present invention may widely be applied to a printing apparatus such as a printer composite machine, a copying machine, a facsimile apparatus, a manufacturing device of various types of device, and so forth. The print processing is not restricted to any method, and may be inkjet method, electrophotography method, thermal transfer method, liquid development method, or the like. Also, the present invention is not restricted to print processing, and may be applied to a sheet processing device which subjects a continuous sheet to various types of processing (recording, processing, coating, irradiation, scanning, inspection, and so forth).

Figure 1:
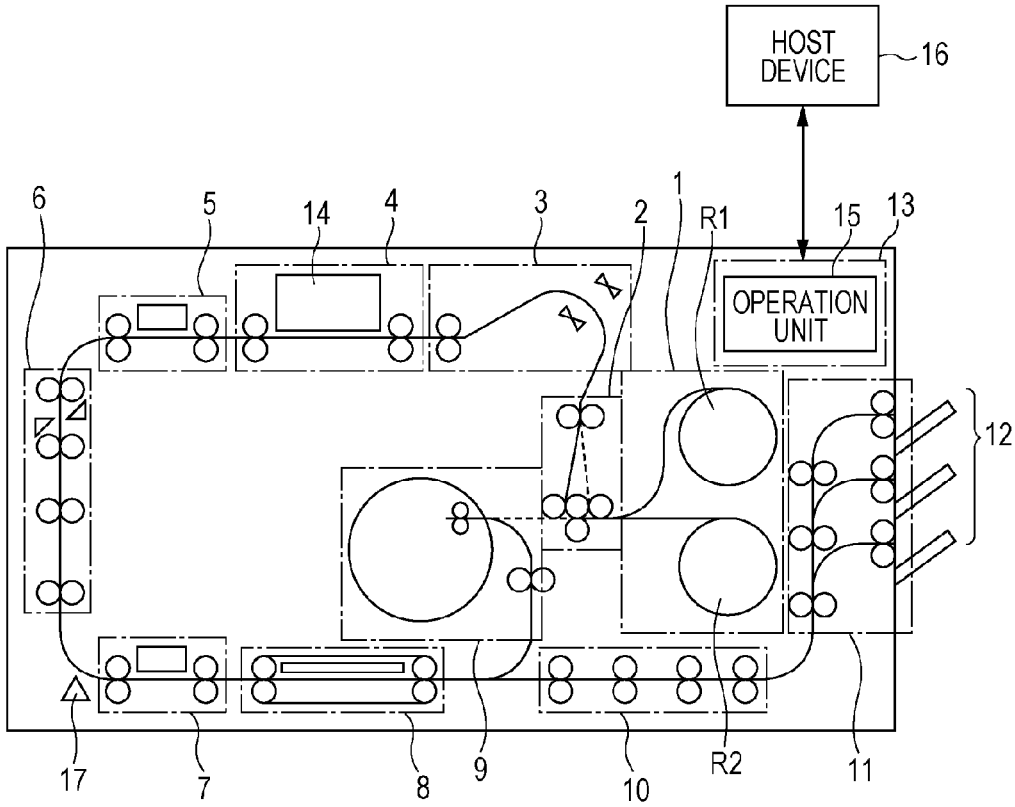
FIG. 1 is a schematic view illustrating the internal configuration of a printing apparatus.

FIG. 1 is a schematic view illustrating the internal configuration of the printing apparatus. The printing apparatus according to the present embodiment is capable of using a sheet wound in a rolled state to perform duplex printing on a first surface of the sheet and a second face on the back face side of the first surface. The printing apparatus principally includes each unit of a sheet feeding unit 1, a decurling unit 2, a skew correcting unit 3, a print unit 4, an inspection unit 5, a cutter unit 6, an information recording unit 7, a drying unit 8, a reverse unit 9, a discharge conveying unit 10, a sorter unit 11, a discharge unit 12, and a control unit 13. The sheet is conveyed by a conveying mechanism made up of a roller pair and a belt and so forth along a sheet conveying path indicated with a solid line in the drawing, and is processed at each unit. Note that with an arbitrary position of the sheet conveying path, the side near the sheet feeding unit 1 is refereed to as "upstream", and the opposite side thereof is referred to as "downstream".

The sheet feeding unit 1 is a unit for holding and feeding a continuous sheet wound in a rolled state. The sheet feeding unit 1 is capable of housing two rolls R1 and R2, and has a configuration for alternatively paying out sheets to be fed. Note that the number of rolls to be housed is not restricted to two, and one or three or more may be housed.

The decurling unit 2 is a unit for reducing curling (warping) of the sheet fed from the sheet feeding unit 1. With the decurling unit 2, curling is reduced by decurling force being influenced by passing through the sheet in a bent manner so as to provide warping in the opposite direction using two pinch rollers as to one driving roller.

The skew correcting unit 3 is a unit for correcting skewing of the sheet having passed through the decurling unit 2 (angle as to the true direction of travel). The inclination of the sheet is corrected by pressing a sheet edge portion on the side serving as a reference against a guide member.

The print unit 4 is a sheet processing unit for subjecting a sheet to be conveyed to print processing by a print head 14 to form an image. That is to say, the print unit 4 is a processing unit for subjecting the sheet to predetermined processing. The print unit 4 also includes multiple conveying rollers to convey a sheet. The print head 14 includes a line-type print head where a nozzle train of the inkjet method is formed in a range covering the maximum width of a sheet to be used. With the print head 14, multiple print heads are arrayed in parallel along the conveying direction. With the present example, the print head 14 includes seven print heads corresponding to seven colors of C (cyan), M (magenta), Y (yellow), LC (light cyan), LM (light magenta), G (gray), and K (black). Note that the number of colors, and the number of print heads are not restricted to seven. As for the inkjet method, there may be employed a method using a heater element, a method using a piezo-electric element, a method using an electrostatic device, a method using an MEMS element, or the like. The ink of each color is supplied to the print head 14 via the corresponding ink tube from an ink tank.

The inspection unit 5 is a unit for optically scanning a test pattern or image printed on a sheet at the print unit 4 by a scanner to determine whether the image has correctly been printed by inspecting the states of the nozzles of the print head, sheet conveying state, image position, and so forth. The scanner includes a CCD image sensor or CMOS image sensor.

The cutter unit 6 is a unit including a mechanical cutter for cutting a sheet after printing into a predetermined length. The cutter unit 6 also includes multiple conveying rollers for feeding out the sheet to the next process.

The information recording unit 7 is a unit for recording print information (unique information) in a non-print region of the cut sheet, such as the serial number or date or the like of printing. Recording is performed by printing characters or code by the inkjet method or thermal transfer method or the like. A sensor 17 for detecting the leading edge of the cut sheet is provided to the upstream side of the information recording unit 7 and the downstream side of the cutter unit 6. That is to say, timing for recording information at the information recording unit 7 is controlled based on the detection timing of the sensor 17 which detects the edge portion of a sheet between the cutter unit 6 and the recorded position by the information recording unit 7.

The drying unit 8 is a unit for heating the sheet printed by the print unit 4 to dry the applied ink in a short period of time. The sheet to be passed through is applied with heated air from at least the lower face side to dry the ink applied face within the drying unit 8. Note that the drying method is not restricted to the method for applying heated air, and may be a method for irradiating electromagnetic waves (such as an ultraviolet ray, infrared ray, or the like) on the sheet front face.

The above sheet conveying path from the sheet feeding unit 1 to the drying unit 8 will be referred to as a first path. The first path has a shape which performs a U-turn between the print unit 4 and the drying unit 8, and the cutter unit 6 is positioned in the middle of the U-turn shape.

The reverse unit 9 is a unit for temporarily winding the continuous sheet of which the front face printing has been completed around to reverse both sides at the time of performing duplex printing. The reverse unit 9 is provided in the middle of a path (loop path) (referred to as "second path") from the drying unit 8 to the print unit 4 via the decurling unit 2 for feeding the sheet passed through the dying unit 8 to the print unit 4 again. The reverse unit 9 includes a winding rotary member (drum) which rotates for winding the sheet around. The continuous sheet of which the front face has been completed has not been cut is temporarily wound around the winding rotary member. At the time of winding being completed, the winding rotary member rotates in reverse, the sheet wound around is fed out in the reverse order at the time of winding around the decurling unit 2, and is fed to the print unit 4. Both sides of this sheet have been reversed, so the back face can be printed at the print unit 4. More specific operation of duplex printing will be described later.

The discharge conveying unit 10 is a unit for conveying the sheet cut at the cutter unit 8 and dried at the drying unit 8 to transfer the sheet to the sorter unit 11. The discharge conveying unit 10 is provided to a path different from the second path where the reverse unit 9 is provided (referred to as "third path"). In order to selectively guide the sheet conveyed in the first path into any one of the second path and third path, a path switching mechanism having a movable flapper is provided to a branching position of the paths.

The sorter unit 11 and the discharge unit 12 are provided to the side portion of the sheet feeding unit 1 and also the tail end of the third path. The sorter unit 11 is a unit for classifying the printed sheet for each group as appropriate. The classified sheet is discharged to the discharge unit 12 made up of multiple trays. In this way, the third path has a layout where the sheet is passed through the lower side of the sheet feeding unit 1 and is discharged to the opposite side of the print unit 4 and the drying unit 8 sandwiching the sheet feeding unit 1.

As described above, the sheet feeding unit 1 through the drying unit 8 are provided to the first path in order. The end of the drying unit 8 is branched into the second path and the third path, the reverse unit 9 is provided in the middle of the second path, and the end of the reverse unit 9 joins the first path. The discharge unit 12 is provided to the tail end of the third path.

The control unit 13 is a unit which manages control of each unit of the whole printing apparatus. The control unit 13 includes a CPU, a storage device, a controller including various types of control unit, an external interface, and an operation unit 15 by which a user performs input/output. The operation of the printing apparatus is controlled based on the command from a host device 16 such as a host computer to be connected to the controller directly or via the external interface.

Figure 2:
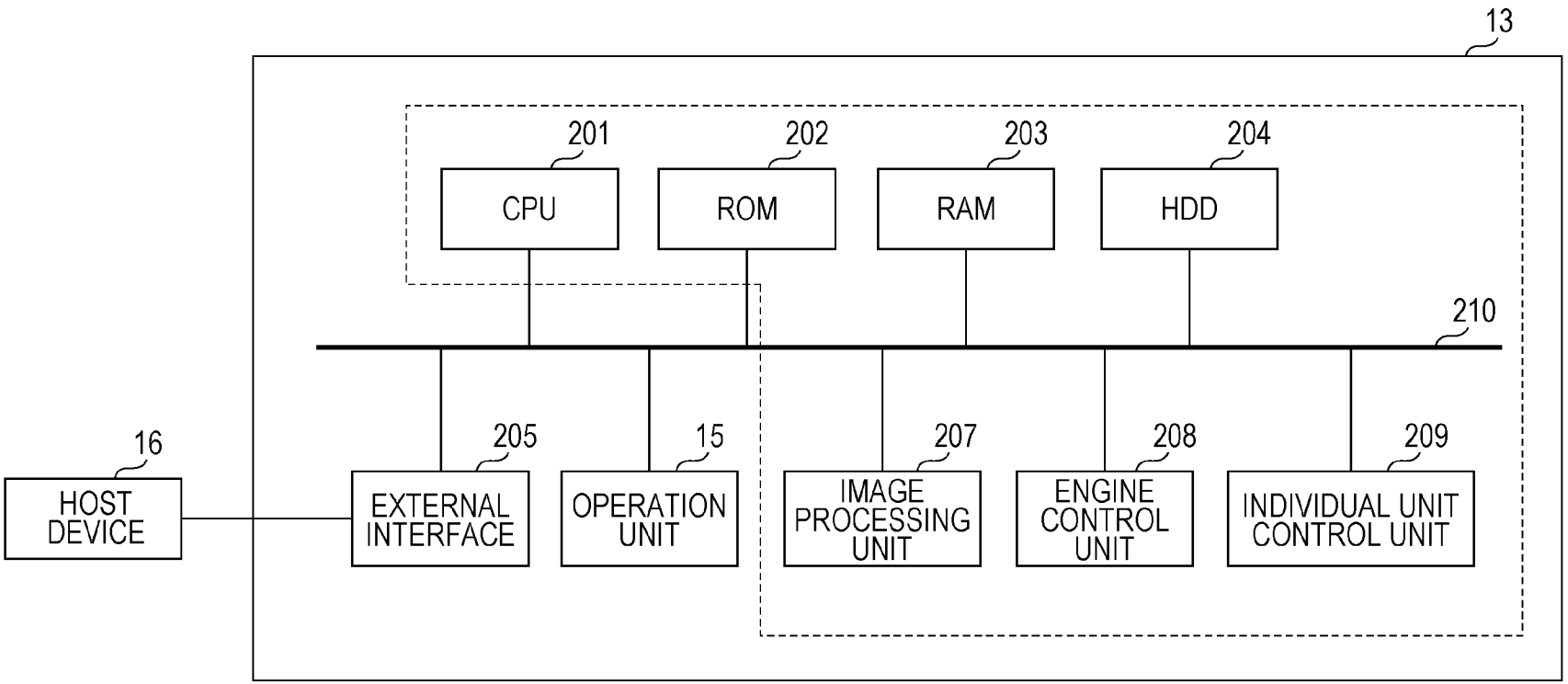
FIG. 2 is a block diagram of a control unit.

FIG. 2 is a block diagram illustrating the concept of the control unit 13. The controller included in the control unit 13 (range surrounded with a dashed line) is configured of a CPU 201, ROM 202, RAM 203, an HDD 204, an image processing unit 207, an engine control unit 208, and an individual unit control unit 209. The CPU 201 (central processing unit) integrally controls the operation of each unit of the printing apparatus. The ROM 202 stores a program to be executed by the CPU 201, and fixed data to be used for various types of operation of the printing apparatus. The RAM 203 is used as the work area of the CPU 201, or used as a temporarily storage region of various types of reception data, or used for storing various types of setting data. The HDD 204 (hard disk) can store or read out a program to be executed by the CPU 201, print data, and setting information used for various types of operation of the printing apparatus. The operation unit 15 is an input/output interface with the user, and includes an input unit such as a hard key or touch panel, and an output unit such as a display for presenting information, an audio generator, or the like.

A dedicated processing unit is provided regarding a unit which requires high-speed data processing. The image processing unit 207 performs the image processing of print data to be handled at the printing apparatus. The image processing unit 207 converts the color space of the input image data (e.g., YCbCr) into standard RGB color space (e.g., sRGB). Also, the image data is subjected to various types of image processing such as resolution conversion, image analysis, image correction, or the like as appropriate. The print data obtained by these image processes is stored in the RAM 203 or HDD 204. The engine control unit 208 performs driving control of the print head 14 of the print unit 4 according to the print data based on the control command received from the CPU 201 or the like. The engine control unit 208 further performs control of the conveying mechanism of each unit within the printing apparatus. The individual unit control unit 209 is a sub controller for individually controlling each unit of the sheet feeding unit 1, decurling unit 2, skew correcting unit 3, inspection unit 5, cutter unit 6, information recording unit 7, drying unit 8, reverse unit 9, discharge conveying unit 10, sorter unit 11, and discharge unit 12. The operation of each unit is controlled by the individual unit control unit 209 based on the command by the CPU 201. The external interface 205 is an interface for connecting the controller to the host device 16, and is a local interface or network interface. The above components are connected by a system bus 210.

The host device 16 is a device serving as the supply source of image data for causing the printing apparatus to perform printing. The host device 16 may be a general-purpose or dedicated computer, or may be dedicated image equipment such as an image capture having an image reader unit, a digital camera, photo storage, or the like. In the event that the host device 16 is a computer, OS, application software for generating image data, and a printer driver for printing apparatus are installed into a storage device included in the computer. Note that it is not essential that all of the above processes are realized by software, so part or all may be realized by hardware.

Next, basic operation at the time of printing will be described. With printing, the operation differs depending on the simplex print mode or the duplex print mode, so each will be described.

Figure 3A:
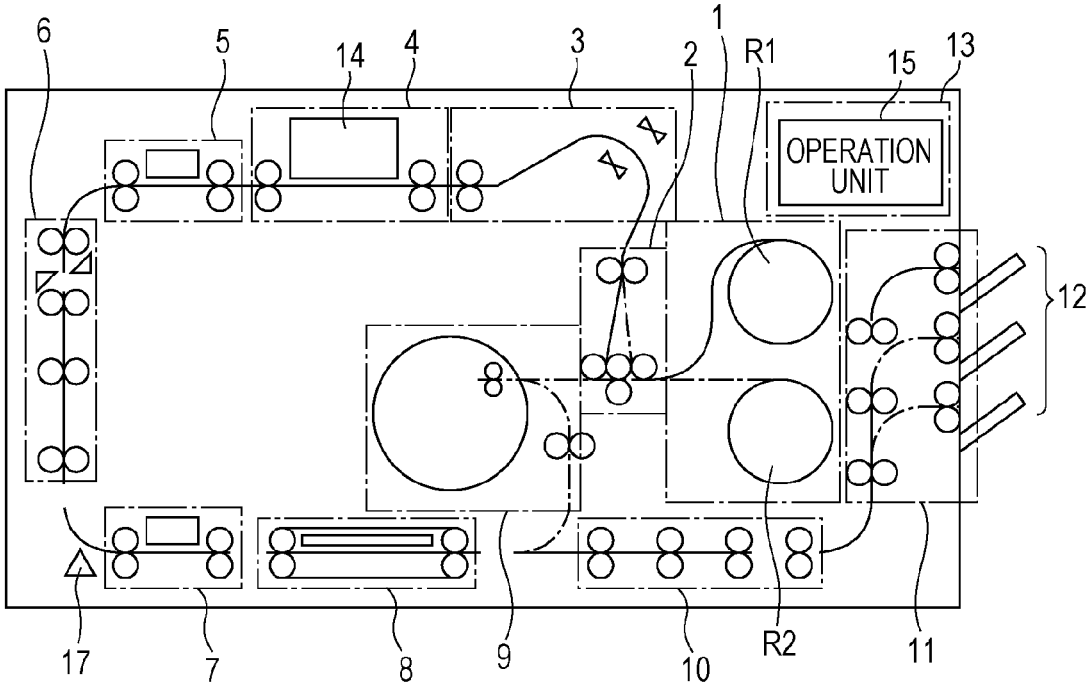
FIGS. 3A and 3B are diagrams for describing the operation in a simplex print mode and a duplex print mode.

FIG. 3A is a diagram for describing the operation in the simplex print mode. With the sheet fed from the sheet feeding unit 1, and processed at each of the decurling unit 2 and skew correcting unit 3, printing of the front face (first surface) is performed at the print unit 4. The image (unit image) of a predetermined unit length in the conveying direction is sequentially printed to array the multiple images as to the long continuous sheet. The printed sheet is cut for each unit image at the cutter unit 6 via the inspection unit 5. With the cut sheets, print information is recorded on the back faces of the sheets by the information recording unit 7 as appropriate. The cut sheets are conveyed to the drying unit 8 one sheet at a time, and are dried. Subsequently, the cut sheets are sequentially discharged to the discharge unit 12 of the sorter unit 11 via the discharge conveying unit 10, and are loaded. On the other hand, the sheets left behind to the print unit 4 side at the time of cutting of the last unit image is fed back to the sheet feeding unit 1, and the sheets are wound around the rolls R1 and R2.

In this way, with simplex printing, the sheet is passed through the first path and the third path and is processed, but is not passed through the second path. If the above is summarized, with the simplex print mode, the following (1) through (6) sequence is executed by the control of the control unit 13.

(1) Feed out the sheet from the sheet feeding unit 1 to feed to the print unit 4.
(2) Repeat printing of a unit image on the first surface of the fed sheet at the print unit 4.
(3) Repeat cutting of the sheet at the cutter unit 6 for each unit image printed on the first surface.
(4) Pass the sheet cut for each unit image through the drying unit 8 one sheet at a time.
(5) Discharge the sheet passed through the drying unit 8 to the discharge unit 12 through the third path one sheet at a time.
(6) Feed the sheet left behind to the print unit 4 side by the last unit image being cut, back to the sheet feeding unit 1.

Figure 3B:
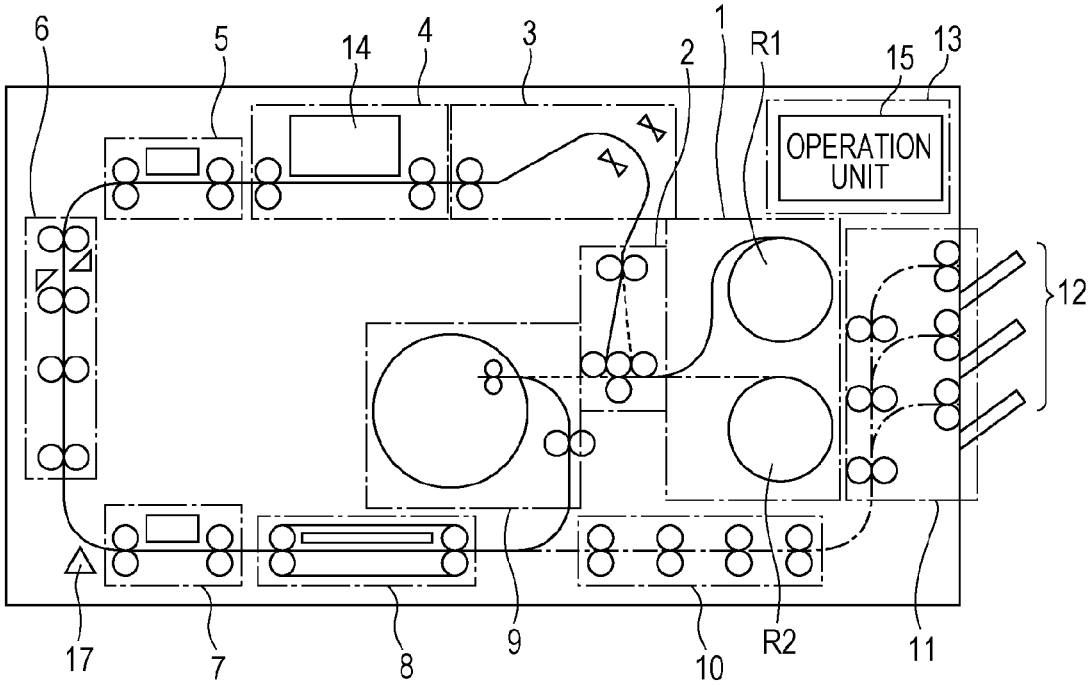

FIG. 3B is a diagram for describing the operation in the duplex print mode. With duplex printing, back face (second face) print sequence is executed following the front face (first surface) print sequence. With the first front face print sequence, the operation at each unit from the sheet feeding unit 1 to the inspection unit 5 is the same as the operation of the above simplex printing. Cutting operation is not performed at the cutter unit 6, and the sheet is conveyed to the drying unit 8 still in the continuous sheet form. After ink drying of the front face at the drying unit 8, the sheet is guided not to the path on the discharge conveying unit 10 (third path) but to the path on the reverse unit 9 side (second path). With the second path, the sheet is wound around the winding rotary member of the reverse unit 9 which rotates in the forward direction (counter clockwise direction in the drawing). After the scheduled front face printing is all completed at the print unit 4, the trailing edge of the print region of the continuous sheet is cut at the cutter unit 6. The continuous sheet on the conveying direction downstream side (printed side) is all wound around up to the sheet trailing edge (cut position) at the reverse unit 9 through the drying unit 8 with the cut position as a reference. On the other hand, the continuous sheet left behind to the conveying direction upstream side (print unit 4 side) rather than the cut position is wound back to the sheet feeding unit 1 so that the sheet leading edge (cut position) is not left behind to the decurling unit 2, and the sheet is wound around the rolls R1 and R2. Collision with the sheet to be fed again in the following back face print sequence is avoided according to this winding back.

After the above front face print sequence, the front print sequence is switched to the back face print sequence. The winding rotary member of the reverse unit 9 rotates in the opposite direction (clockwise direction in the drawing) of the direction at the time of being wound around. The edge portion of the sheet wound around (the sheet trailing edge at the time of being wound around becomes the sheet leading edge at the time of being fed back) is fed to the decurling unit 2 along the path indicated with a dashed line in the drawing. Correction of curling applied by the winding rotary member is performed at the decurling unit 2. That is to say, the decurling unit 2 is a common unit which serves decurling in either path, provided between the sheet feeding unit 1 and the print unit 4 in the first path, and provided between the reverse unit 9 and the print unit 4 in the second path. The sheet of which both sides are inverted is fed to the print unit 4 via the skew correcting unit 3, where the back face of the sheet is performed. The printed sheet is fed to the cutter unit 6 via the inspection unit 5, and is cut at the cutter unit 6 for each predetermined unit length. With the cut sheet, both sides are printed, so recording at the information recording unit 7 is not performed. The cut sheet is conveyed to the drying unit 8 one sheet at a time, and is sequentially discharged and loaded in the discharge unit 12 of the sorter unit 11 via the discharge conveying unit 10.

In this way, with duplex printing, the sheet is processing passing through the first path, second path, first path, and third path in this order. If the above is summarized, with the duplex print mode, the following (1) through (11) sequence is executed by the control of the control unit 13.

(1) Feed out the sheet from the sheet feeding unit 1 to feed to the print unit 4.
(2) Repeat printing of a unit image on the first surface of the fed sheet at the print unit 4.
(3) Pass the sheet of which the first surface is printed, through the drying unit 8.
(4) Lead the sheet passed through the drying unit 8 into the second path to wind the sheet around the winding rotary member included in the reverse unit 9.
(5) Cut the sheet at the cutter unit 6 at the end of the last printed unit image after repetition of printing as to the first surface.
(6) Wind the cut sheet around the winding rotary member until the edge portion of the cut sheet passes through the drying unit 8 and reaches the winding rotary member. Also feed the sheet cut and left behind to the print unit 4 side, back to the sheet feeding unit 1.
(7) Rotate the winding rotary member in reverse after winding the sheet around, and feed the sheet to the print unit 4 from the second path again.
(8) Repeat printing of a unit image on the second face of the sheet fed from the second path at the print unit 4.
(9) Repeat cutting of the sheet at the cutter unit 6 for each unit image printed on the second face.
(10) Pass the sheet cut for each unit image through the drying unit 8 one sheet at a time.
(11) Discharge the sheet passed through the drying unit 8 to the discharge unit 12 through the third path one sheet at a time.

Figure 7:
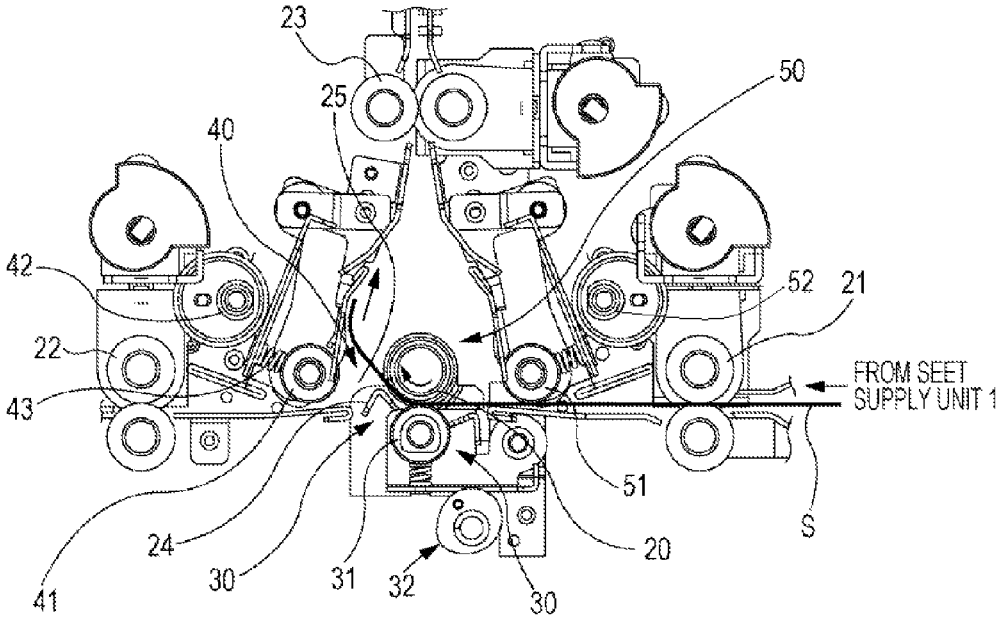
FIG. 7 is a diagram for describing decurling operation of front face printing.
Figure 8:
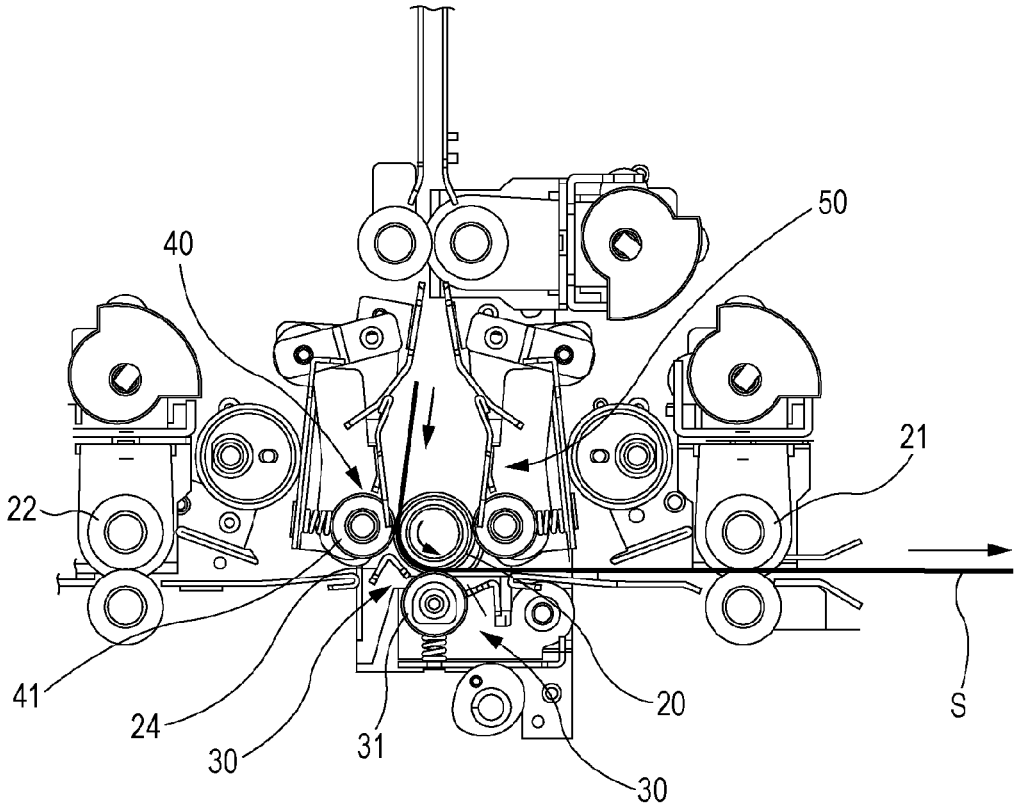
FIG. 8 is a diagram for describing decurling operation of front face printing.
Figure 9:
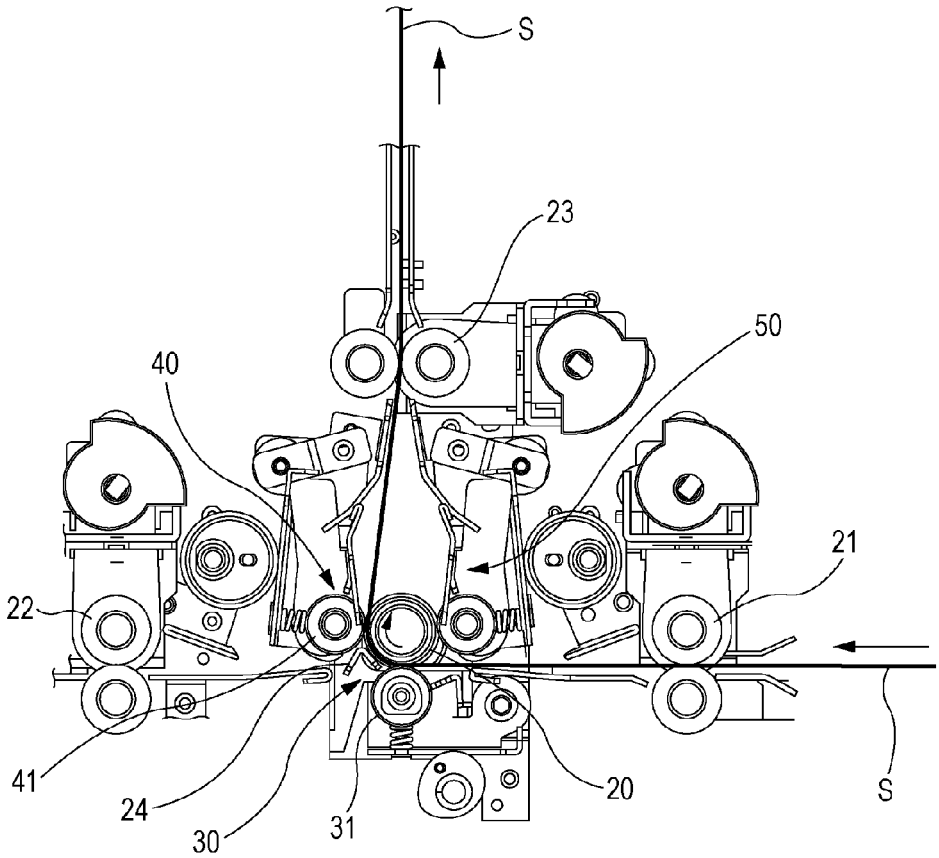
FIG. 9 is a diagram for describing decurling operation of front face printing.

Next, description will be made more in detail regarding curl correction operation at the decurling unit 2 of the printing apparatus having the above configuration. FIGS. 7 through 9 are diagrams for describing the configuration and operation of the decurling unit 2. The decurling unit 2 includes a decurling roller 20 for locally bending the sheet to provide decurling force, and a first pinch roller 31, which faces the decurling roller 20, capable of forming a nip therebetween. The decurling unit 2 further includes a second pinch roller 41 and a third pinch roller 51 disposed on both sides so as to sandwich the first pinch roller with the circumference of the decurling roller 20. The decurling roller 20 and the first pinch roller 31 make up a first decurling roller pair 30, the decurling roller 20 and the second pinch roller 41 make up a second decurling roller pair 40, and the decurling roller 20 and the third pinch roller 51 make up a third decurling roller pair 50. Each of these decurling roller pairs is capable of independently forming a nipped state (capable of separation and contact).

The decurling unit 2 further includes a first lead-in roller pair 21 for conveying and leading the sheet to be fed from the sheet feeding unit 1 (first sheet feeding unit), and a second lead-in roller pair 22 for conveying and leading the sheet to be fed from the reverse unit 9 (second sheet feeding unit). The decurling unit 2 further includes a discharge roller pair 23 for discharging the sheet from the decurling unit 2. A cam 32 and a pressing spring 33 make up a driving mechanism for switching the nipped state by the first pinch roller 31 (capable of separation and contact). A cam 42 and a pressing spring 43 make up a driving mechanism for switching the nipped state by the second pinch roller 41. A cam 52 and a pressing spring 53 make up a driving mechanism for switching the nipped state by the third pinch roller 51.

Figure 4:
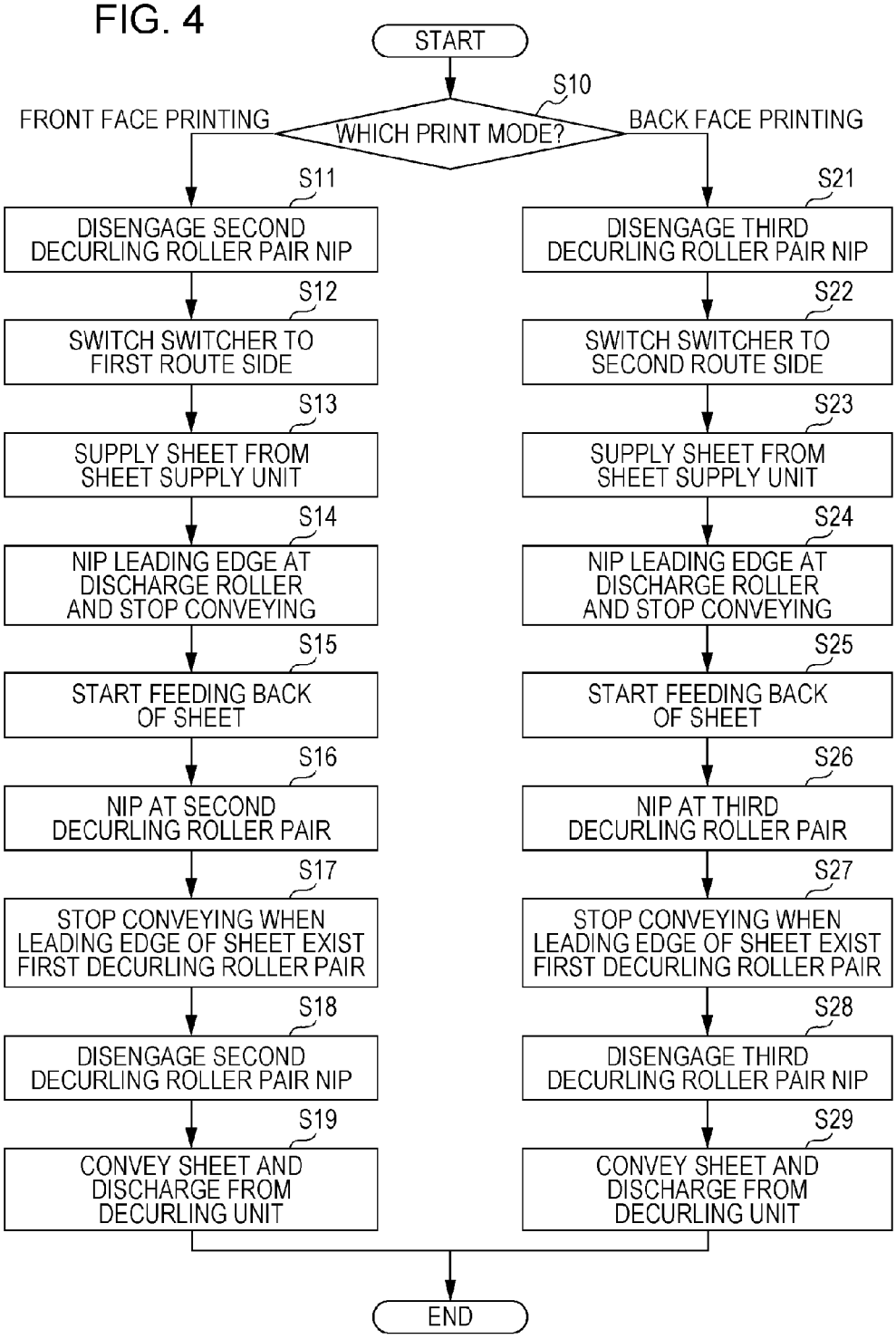
FIG. 4 is a flowchart illustrating the sequence of decurling operation.

FIG. 4 is a flowchart illustrating the sequence of the decurling operation. The sequence differs depending on whether the current print mode is front face printing (front face printing in the simplex print mode and duplex print mode) or back face printing (back face printing in the duplex print mode).

In step S10, in the event that the current print mode is front face printing, the flow proceeds to step S11, and in the event of back face printing, the flow proceeds to step S21.

In step S11, the first decurling roller pair 30 is changed to a nipped state, and also the second decurling roller pair 40 and the third decurling roller 50 are changed to a separated state, and disengaged from the nip thereof. Specifically, the cams 42 and 52 rotates to lift up the second pinch roller 41 and the third pinch roller 51 from the pressing spring decurling roller 20, whereby the second decurling roller pair 40 and the third decurling roller pair 50 are in a separated state. Note here that it is not essential for the third decurling roller pair 50 to disengage the nip thereof, and it is desirable for at least the second decurling roller pair 40 to disengage the nip thereof.

In step S12, a switcher 24 for changing the advancing direction of a sheet by coming into contact with the sheet is switched to set to a position such as illustrated in FIG. 7. In this state, with the nipped state of the first decurling roller pair 30 as a reference, the switcher 24 enters the path on the opposite side of the sheet feeding unit 1, and evacuates from the path on the sheet feeding unit 1 side. Thus, a sheet S to be fed toward the horizontally left direction in the drawing passed through the first lead-in path from the sheet feeding unit 1 comes into contact with the inclined face of the switcher 24 at a portion passed through the nipped position of the first decurling roller pair 30 to change the advancing direction to the upper left direction in the drawing. The advancing direction of the sheet S is changed without unreasonable stress.

In step S13, feed of the sheet from the sheet feeding unit 1 is started. The leading edge of the sheet S is nipped with the first lead-in roller pair 21 in the first lead-in path, nipped with the first decurling roller pair 30, changed in the advancing direction at the switcher 24, and passes through between the second decurling roller pair 40 of which the nip is disengaged. FIG. 7 illustrates a state in which the sheet S reaches a position passed through a gap 25 of the second decurling roller pair 40 in a separated state.

In step S14, conveyance is further advanced from the state in FIG. 7, where the leading edge of the sheet S is nipped with the discharge roller pair 23, conveyance of the sheet S is temporarily stopped.

In step S15, operation is started wherein the sheet S is fed back in the opposite direction of the previous direction by rotating the decurling roller 20 and the first lead-in roller pair 21 in reverse.

In step S16, the second pinch roller 41 is moved by the cam 42 and the pressing spring 43 to nip the sheet S with the second decurling roller pair 40. According to this operation, the sheet S is wound around the decurling roller 20, and decurling force is applied to the wound portion. The sheet S is in a state bent in the opposite direction of the winding direction of the sheet at the reverse unit 9 with a smaller angle (acute angle) than 90 degrees with the decurling roller 20 as a peak.

FIG. 8 illustrates the decurling operation of the leading edge portion of the sheet S. The sheet S is fed back still in a state in which the sheet S is nipped with the first decurling roller pair 30 and the second decurling roller pair 40. The sheet S is conveyed maintaining a state in which the sheet S is bent in the opposite direction of the sheet winding direction at the roll R1.

In step S17, from this state the sheet S is further fed back until the leading edge of the sheet S is pulled out from the nipped position of the first decurling roller pair 30, and conveyance of the sheet S is stopped. In this way, the sheet S is passed through the decurling roller 20 while the region of a predetermined length from the leading edge of the sheet S is bent in the opposite direction of the direction of curling at the decurling roller 20, and the curling of the leading edge of the sheet S is corrected by decurling force being applied due to the sheet being worked at that time.

In step S18, the nipped state of the second decurling roller pair 40 is disengaged.

In step S19, conveyance of the sheet in the forward direction is resumed. Note that the curling of the sheet paid out from the roll may be extremely great depending on the type of the sheet S to be used, and there is a possibility that desired correction may not be obtained with a one-time decurling operation. In such a case, the decurling operation of the leading edge portion of the sheet due to the above feeding back operation may be repeated multiple number of times (twice or more).

Upon the sheet leading edge passing through the second decurling roller pair 40 and being nipped with the discharge roller pair 23, the second decurling roller pair 40 is changed to a nipped state. Subsequently, conveyance of the sheet is continued, and the sheet is discharged from the decurling unit 2.

FIG. 9 illustrates a scene wherein after the decurling operation of the leading edge of the sheet S illustrated in FIG. 8, the sheet S is passed through the decurling unit 2, and is fed to the print unit 4. At this time as well, the sheet S is bent by being wound around the decurling roller 20 with an acute angle, and decurling force is applied to all of the regions of the sheet S to be fed from the sheet feeding unit 1. The sheet leading edge portion repeatedly (three times in total) is passed through the decurling roller 20 according to the above feeding back operation, so more decurling force is applied to the leading edge of the sheet S that particularly requires decurling.

Figure 13:
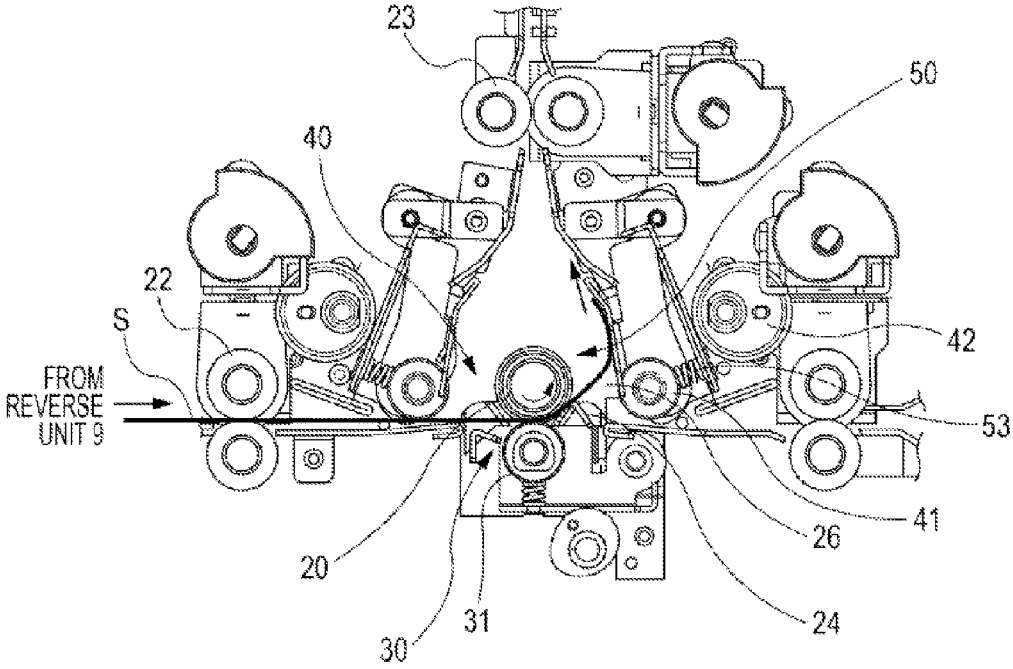
FIG. 13 is a diagram for describing decurling operation with back face printing.
Figure 14:
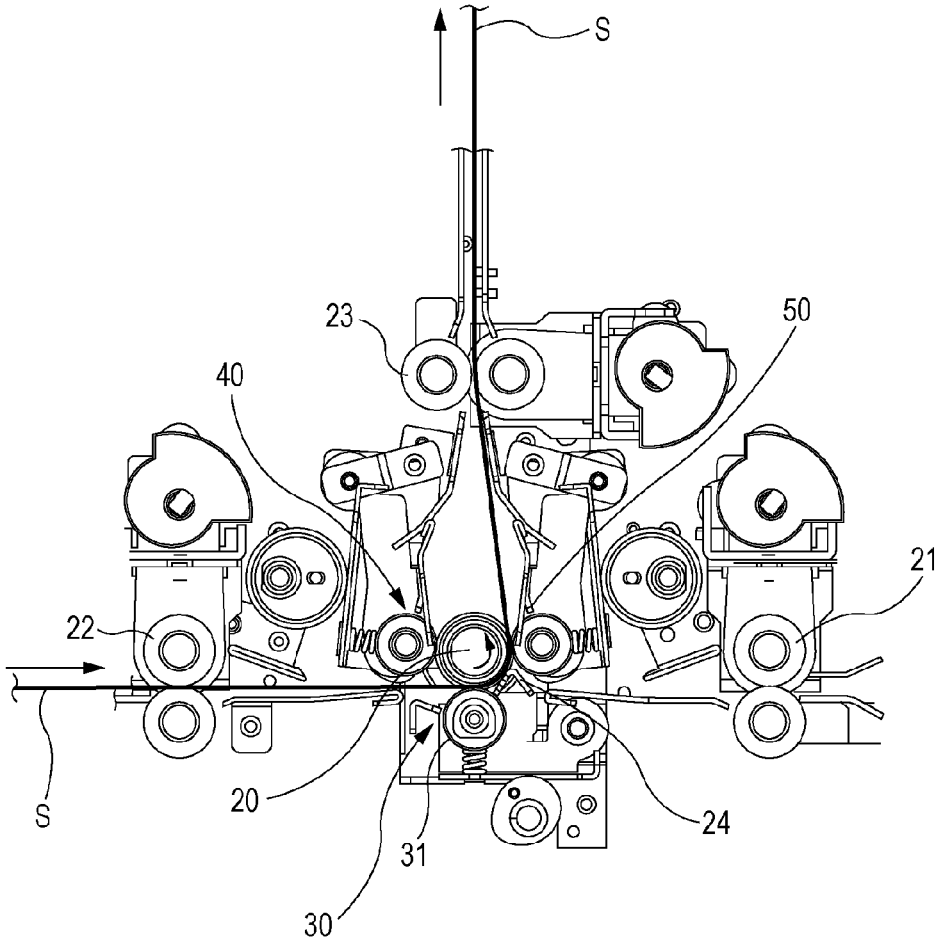
FIG. 14 is a diagram for describing decurling operation with back face printing.

On the other hand, in the event that determination is made in step S10 that the current print mode is back face printing and the flow proceeds to step S21, the following sequence is executed. FIGS. 13 and 14 are diagrams for describing the operation of the decurling unit 2 with back face printing. As described above, with back face printing, the sheet S is fed form the reverse unit 9 (second feed unit) to the decurling unit 2.

In step S21, the first decurling roller pair 30 is changed to a nipped state, and also at least the third decurling roller pair 50 is changed to a separated state to disengage the nip thereof.

In step S22, the switcher 24 is switched to be set to a position such as illustrated in FIG. 13. In this state, with the nip position of the first decurling roller pair 30 as a reference, the switcher 24 enters the path on the sheet feeding unit 1 side (the opposite side of the reverse unit 9), and the switcher 24 is evacuated from the path on the opposite side of the sheet feeding unit 1 (reverse unit 9 side). Thus, the sheet S to be fed toward the horizontally right direction in the drawing passed through the second lead-in path from the reverse unit 9 comes into contact with the inclined face of the switcher 24 at a portion passed through the nipped position of the first decurling roller pair 30 to change the advancing direction to the upper right direction in the drawing. The sheet S is changed in the advancing direction without receiving unreasonable stress.

In step S23, feed of the sheet from the reverse unit 9 is started. The leading edge of the sheet S is nipped with the second lead-in roller pair 22 in the second lead-in path, nipped with the first decurling roller pair 30, changed in the advancing direction at the switcher 24, and passes through between the third decurling roller pair 50 of which the nip is disengaged. FIG. 13 illustrates a state in which the sheet S reaches a position passed through a gap 26 of the third decurling roller pair 50 in a separated state.

In step S24, conveyance is further advanced from the state in FIG. 13, where the leading edge of the sheet S is nipped with the discharge roller pair 23, conveyance of the sheet S is temporarily stopped.

In step S25, operation is started wherein the sheet S is fed back in the opposite direction of the previous direction by rotating the decurling roller 20 and the second lead-in roller pair 22 in reverse.

In step S26, the third pinch roller 51 is moved by the cam 52 and the pressing spring 53 to nip the sheet S with the third decurling roller pair 50. According to this operation, the sheet S is wound around the decurling roller 20, and decurling force is applied to the wound portion. The sheet S is in a state bent in the opposite direction of the winding direction of the sheet at the reverse unit 9 with a smaller angle (acute angle) than 90 degrees with the decurling roller 20 as a peak.

The sheet S is fed back still in a state nipped with the first decurling roller pair 30 and the third decurling roller pair 50.

The sheet S is conveyed while maintaining a state bent in the opposite direction of the winding direction of the sheet at the reverse unit 9 (state to which decurling force is applied).

In step S27, from this state the sheet S is further fed back until the leading edge of the sheet S is pulled out from the nipped position of the first decurling roller pair 30, and conveyance of the sheet S is stopped. In this way, the sheet S is passed through the decurling roller 20 while the region of a predetermined length from the leading edge of the sheet S is bent in the opposite direction of the direction of curling at the decurling roller 20, whereby the curling of the leading edge of the sheet S is corrected.

In step S28, the nip of the third decurling roller pair 50 is disengaged again. Next, in step S29, conveyance of the sheet in the forward direction is resumed. Upon the sheet leading edge passing through the third decurling roller pair 50 and being nipped with the discharge roller pair 23, the third decurling roller pair 50 is changed to a nipped state. Subsequently, conveyance of the sheet is continued, and the sheet is discharged from the decurling unit 2. FIG. 14 illustrates a scene wherein after the decurling operation of the leading edge of the sheet S, the sheet S is passed through the decurling unit 2, and is fed to the print unit 4. At this time as well, the sheet S is bent by being wound around the decurling roller 20 with an acute angle, and decurling force is applied to all of the regions of the sheet S to be fed from the reverse unit 9.

The sheet to be wound around the winding rotary member of the reverse unit 9 after printing to the first surface is wound around so that the first surface of the sheet becomes the outer side (outer circumference) in the same way as with the rolls R1 and R2 of the sheet feeding unit 1. With from the reverse unit 9 (second sheet feeding unit) to the nipped position of the first decurling roller pair 30 of the decurling unit 2, the sheet is led in from the opposite direction (second direction) of the lead-in direction (first direction) of the sheet feeding unit 1 (first sheet feeding unit). Therefore, with the sheet passed through the decurling unit 2, both sides are inverted, and with the print unit 4, the second face of the sheet faces the print head 14.

As described above, decurling operation is performed by the common decurling unit 2, which differs between front face printing (sheet feeding from the sheet feeding unit 1 serving as the first sheet feeding unit) and back face printing (sheet feeding from the reverse unit 9 serving as the second sheet feeding unit).

Note that some types of sheet to be used require no decurling operation. In this case, steps S14 through S18 and steps S24 through S28 in FIG. 4 should be skipped.

Incidentally, during the print operation sequence, conveyance of a sheet may be stopped for some reason. For example, conveyance of a sheet for image data processing is temporarily stopped before image formation. Alternatively, before operation for feeding the sheet S back to the sheet feeding unit 1 or reverse unit 9, sheet conveyance is temporarily stopped. Upon sheet conveyance being stopped over the long term in a state in which the sheet S exists on the decurling unit 2 and is being subjected to curl correction, decurling force continuously affects only the portion thereof, so there is a concern that the sheet S may locally have bending remaining in the opposite direction (reverse curling). Hereafter, description will be made regarding a technique for avoiding this.

Figure 5:
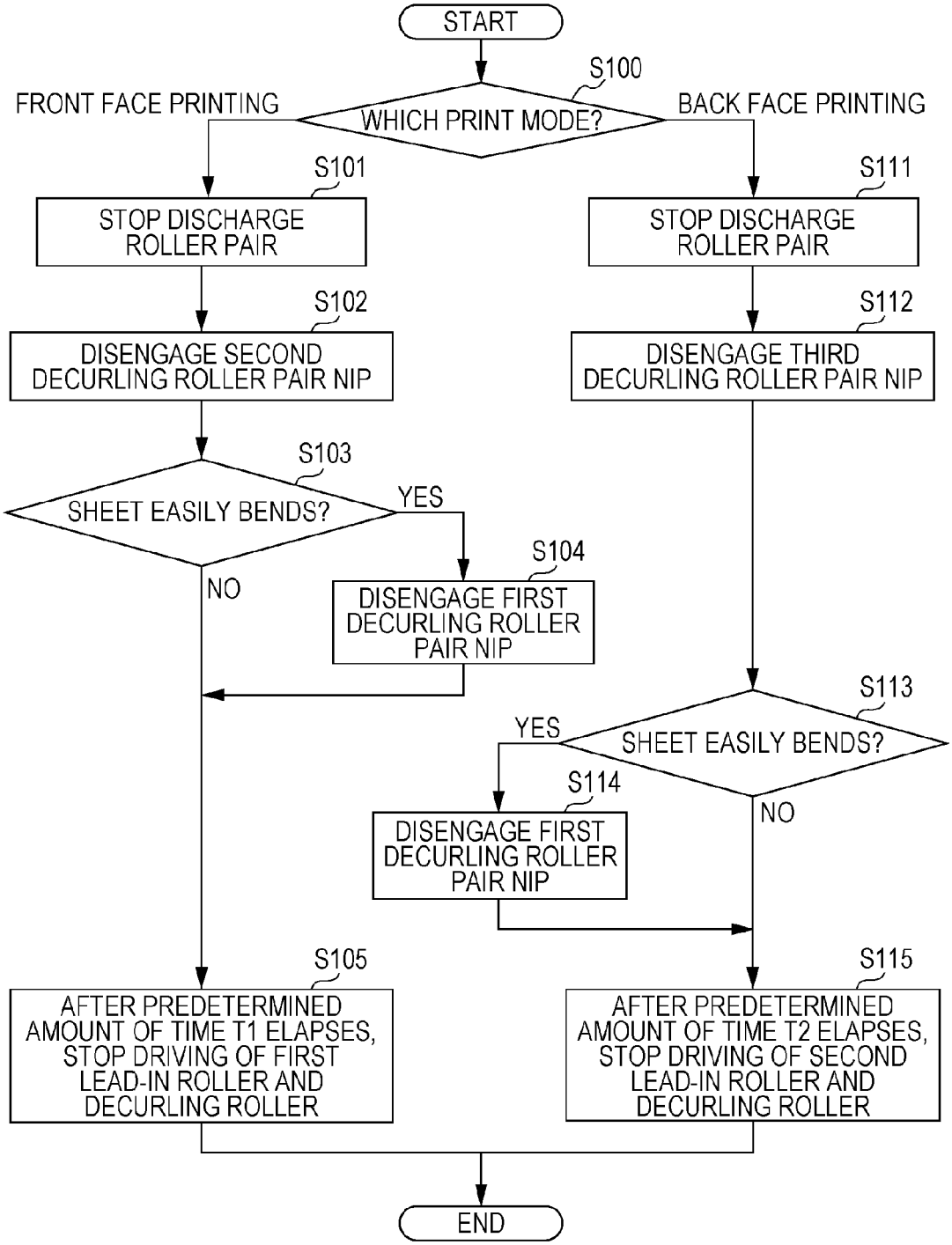
FIG. 5 is a flowchart illustrating the operation sequence of a decurling unit in the event of stopping the conveyance of a sheet during curl correction.

FIG. 5 is a flowchart illustrating the operation sequence of the decurling unit 2 in the event of stopping sheet conveyance during curl correction. In the event of stopping sheet conveyance longer than a predetermined period of time during curl correction, the present sequence is executed. As for the predetermined period of time, a period of time is set such that if conveyance is stopped any longer, a curled state may remain to a degree which might affect printing.

With the operation of the decurling unit 2, the sequence differs depending on regarding whether the current print mode is front face printing or back face printing. In the event of stopping sheet conveyance, in step S100 the current print mode is recognized, and in the event of front face printing, the flow proceeds to step S101, and in the event of back face printing, the flow proceeds to step S111.

Figure 10:
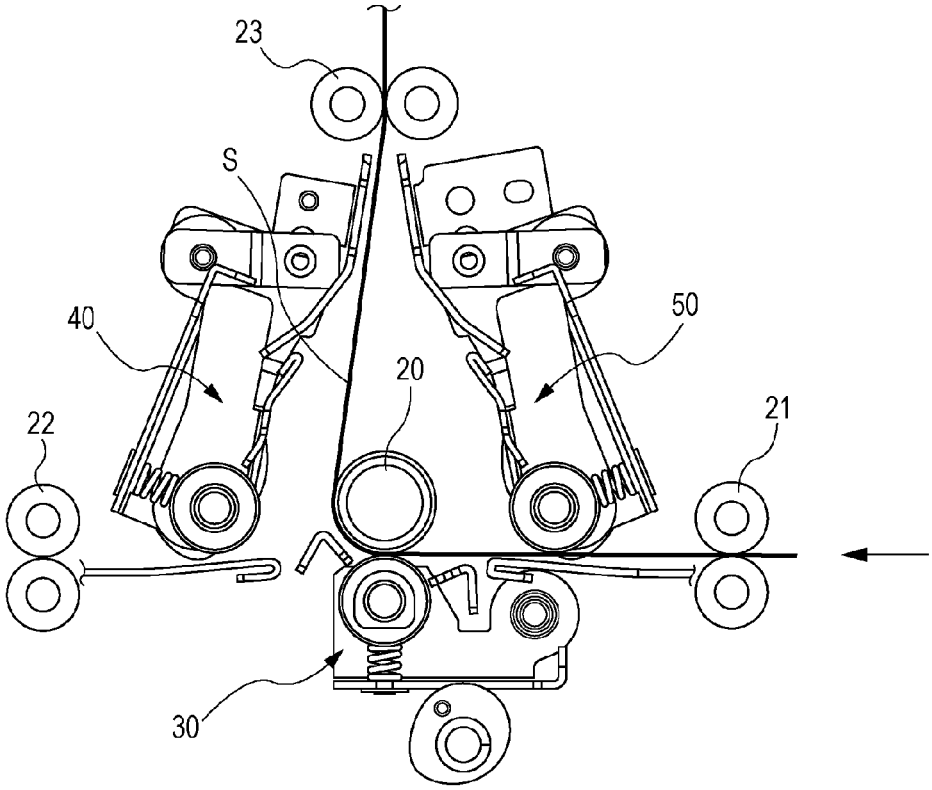
FIG. 10 is a diagram for describing decurling operation at the time of suspension of conveyance of a sheet with front face printing.

The sheet S is led in from the sheet feeding unit 1 via the first lead-in roller pair 21. In step S101, the discharge roller pair 23 positioned further downstream from the decurling roller 20 is stopped. Note that driving of the first lead-in roller pair 21 and the decurling roller 20 other than the discharge roller pair 23 thereof is continued. In step S102, the nip of the second pinch roller pair 40 is disengaged. That is to say, as illustrated in FIG. 10, the second pinch roller 41 is separated from the decurling roller 20, whereby constraining force to wind the sheet S around the decurling roller 20 is released.

In step S103, the control unit determines easiness of bending of the sheet S from the recognized type of sheet. For example, in the event that the stiffness of the sheet S is great, the sheet S is easily bent locally with the bending remaining, so continuously applying decurling force needs to be avoided. In the event that determination is Yes (sheet to be easily bent), the flow proceeds to step S104, and in the event that determination is No (sheet not to be easily bent), the flow skips step S104 to proceed to step S105.

In step S104, the nip of the first pinch roller pair 30 is disengaged. That is to say, the first pinch roller 31 is separated from the decurling roller 20. In step S105, after predetermined amount of time (T1) elapses since driving stop of the discharge roller pair 23 in step S101, driving of the first lead-in roller pair 21 and the decurling roller 20 is stopped.

Figure 11:
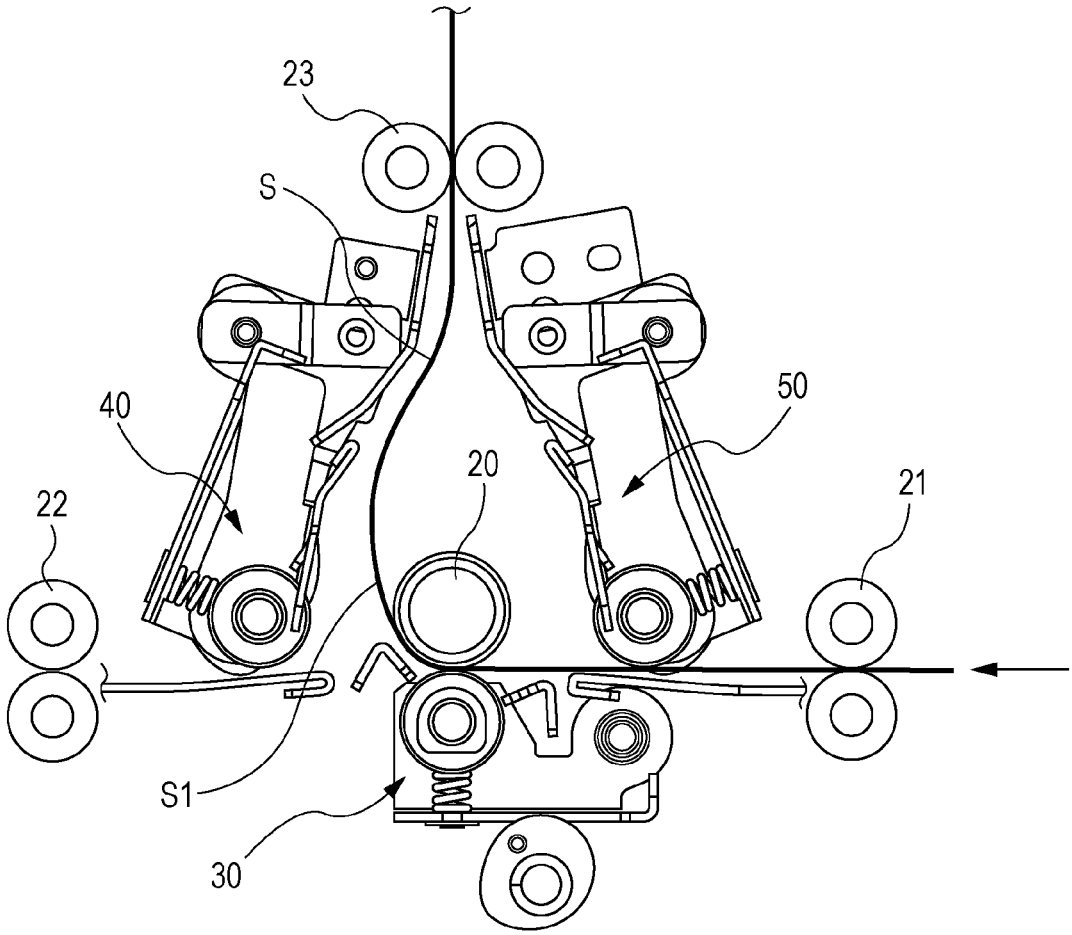
FIG. 11 is a diagram for describing decurling operation at the time of suspension of conveyance of a sheet with front face printing.

In the event that step S104 has been skipped and step S105 has been executed, as illustrated in FIG. 11, the first pinch roller pair 30 is in a state maintaining its nip, and also the second pinch roller pair 40 is in a state disengaging its nip. Therefore, winding around the decurling roller 20 is partially disengaged and alleviated, so the influence of decurling force is partially alleviated, and local bending that remains is prevented from being applied to the sheet S. The sheet S originally has a property not to easily retain the bending, so the sheet S is not affected by partial alleviation of decurling force.

Figure 12:
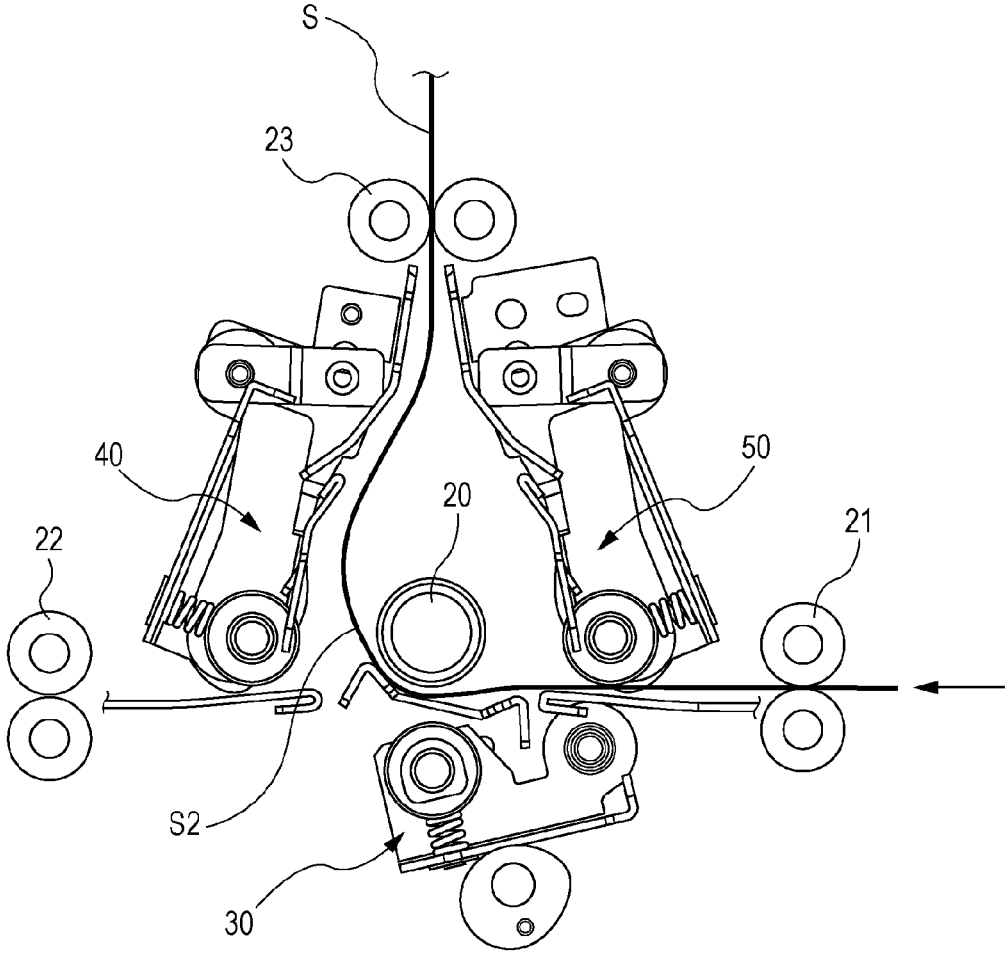
FIG. 12 is a diagram for describing decurling operation at the time of suspension of conveyance of a sheet with front face printing.

In the event that the sequence is executed in order of step S103, step S104, and step S105, as illustrated in FIG. 12, both of the first pinch roller pair 30 and the second pinch roller pair 40 are in a disengaged nip state. Therefore, winding around the decurling roller 20 is all disengaged and alleviated, so there is almost no influence of decurling force, and even if the sheet S has a property to easily retain bending, a local bending that remains is prevented from being applied to the sheet S.

On the other hand, in the event that determination has been made in step S100 that the current print mode is back face printing, and the flow has proceeded to step S111, the following sequence will be executed.

The sheet S is led in from the reverse unit 9 via the second lead-in roller pair 22. In step S111, the discharge roller pair 23 is stopped. Note that the second lead-in roller pair 22 and the decurling roller 20 other than the second lead-in roller pair 22 continue to be driven. In step S112, the nip of the third pinch roller pair 50 is disengaged. That is to say, the third pinch roller 51 is separated from the decurling roller 20, and constraining force to wind the sheet S around the decurling roller 20 is released.

In step S113, the control unit determines easiness of bending of the sheet S from the recognized type of sheet. In the event that determination is Yes (sheet to be easily bent), the flow proceeds to step S114, and in the event that determination is No (sheet not to be easily bent), the flow skips step S114 to proceed to step S115.

In step S114, the nip of the first pinch roller pair 30 is disengaged. That is to say, the first pinch roller 31 is separated from the decurling roller 20. In step S115, after predetermined amount of time (T2) elapses since driving stop of the discharge roller pair 23 in step S111, driving of the second lead-in roller pair 22 and the decurling roller 20 is stopped.

Figure 15:
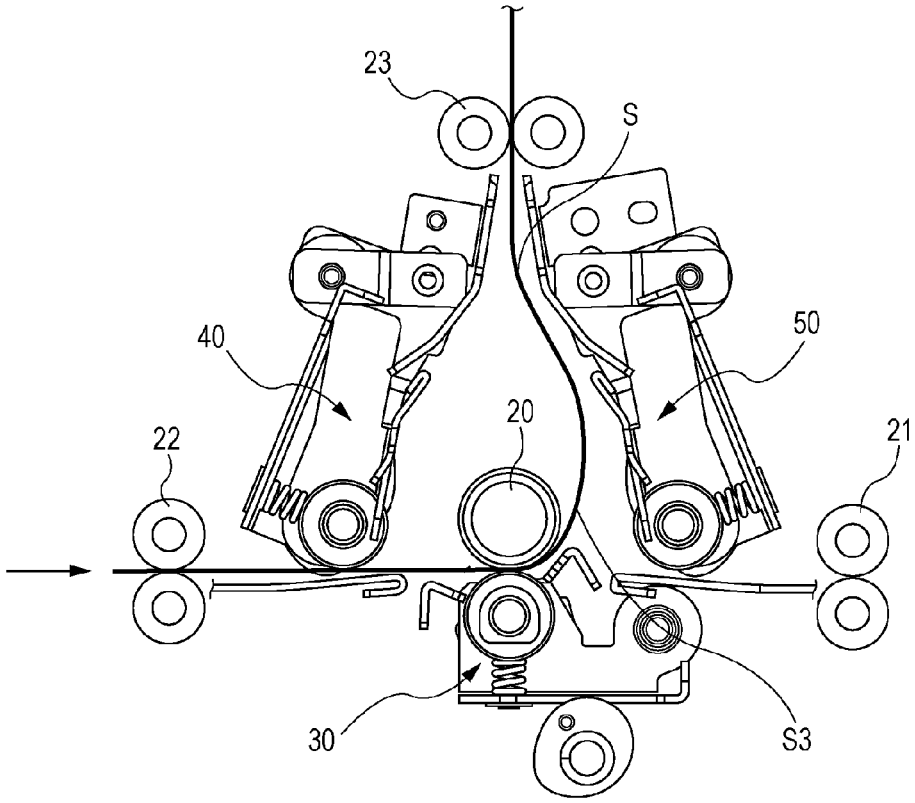
FIG. 15 is a diagram for describing decurling operation at the time of suspension of conveyance of a sheet with back face printing.

In the event that step S114 has been skipped and step S115 has been executed, as illustrated in FIG. 15, the first pinch roller pair 30 is in a state maintaining its nip, and also the third pinch roller pair 50 is in a state disengaging its nip. Therefore, winding around the decurling roller 20 is partially disengaged and alleviated, so the influence of decurling force is partially alleviated, and bending which locally remains is prevented from being applied to the sheet S. The sheet S originally has a property not to easily have a bending which remains, so the sheet S is not affected by partial alleviation of decurling force.

In the event that the sequence is executed in order of step S113, step S114, and step S115, both of the first pinch roller pair 30 and the third pinch roller pair 50 are in a disengaged nip state. Therefore, winding around the decurling roller 20 is all disengaged and alleviated, so there is almost no influence of decurling force, and even if the sheet S has a property to easily have bending which remains, bending which locally remains is prevented from being provided to the sheet S.

Figure 6:
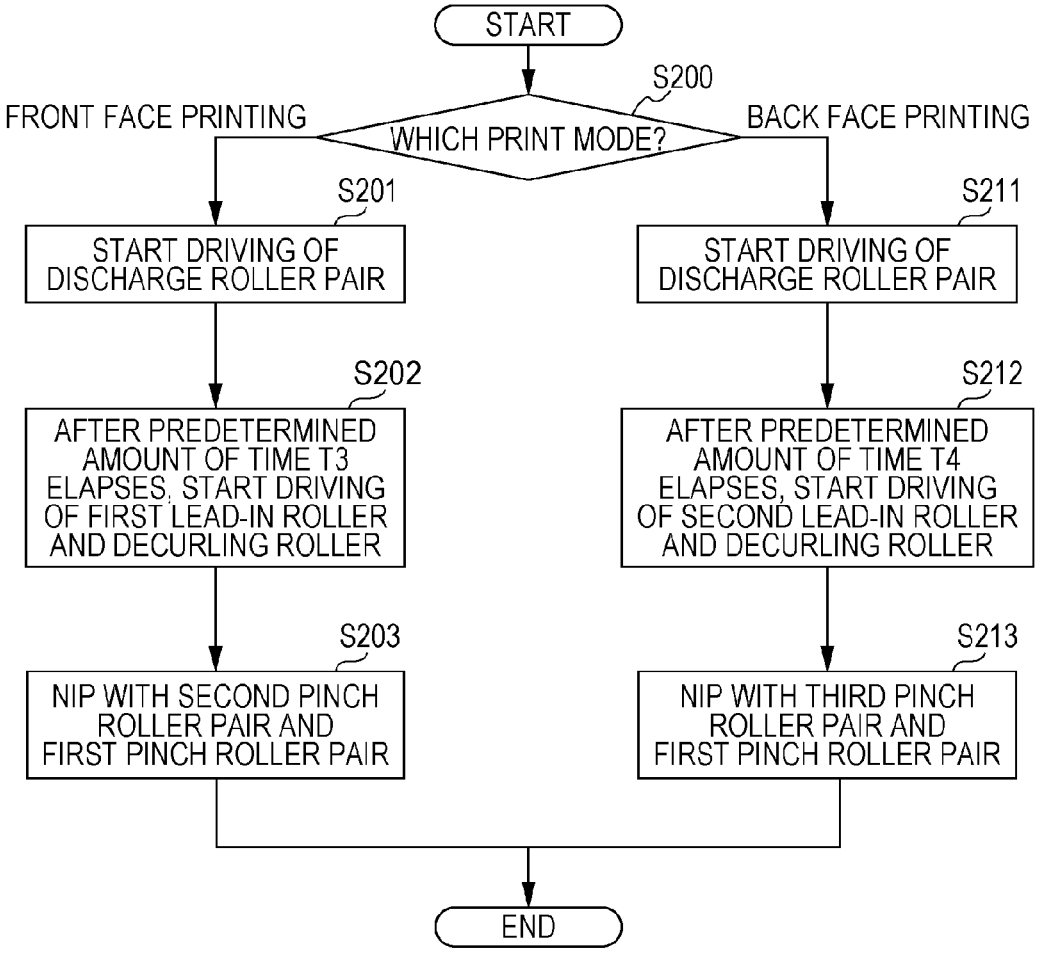
FIG. 6 is a flowchart illustrating the operation sequence of the decurling unit in the event of resuming the conveyance of a sheet.

FIG. 6 is a flowchart illustrating the operation sequence of the decurling unit at the time of resuming conveyance of a sheet. With the operation of the decurling unit 2, the sequence differs depending on whether or not the current print mode is front face printing or back face printing. In step S200, the current print mode is recognized, and in the event of front face printing, the flow proceeds to step S201, and in the event of back face printing, the flow proceeds to step S211.

In step S201, driving of the discharge roller pair 23 is started. In step S202, after predetermined amount of time (T3) elapses since driving start of the discharge roller pair 23, driving of the first lead-in roller pair 21 and the decurling roller 20 is started. Let us say that the predetermined amount of time (T3) is equivalent to time used for eliminating alleviation of winding around the decurling roller 20. In step S203, the second pinch roller pair 40 and the first pinch roller pair 30 are both switched to a nipped state to nip the sheet S. In the event that the first pinch roller pair 30 is originally in a nipped state, only the second pinch roller pair 40 is switched to a nipped state. In this way, the decurling unit 2 is restored to a normal state providing decurling force, and resumes printing operations.

On the other hand, in the event that determination is made in step S200 that the current print mode is back face printing, in step S211 driving of the discharge roller pair 23 is started. In step S212, after predetermined amount of time (T4) elapses since driving start of the discharge roller pair 23, driving of the second lead-in roller pair 22 and the decurling roller 20 is started. Let us say that the predetermined amount of time (T4) is equivalent to time used for eliminating alleviation of winding around the decurling roller 20. In step S213, the third pinch roller pair 50 and the first pinch roller pair 30 are both switched to a nipped state to nip the sheet S. In the event that the first pinch roller pair 30 is originally in a nipped state, only the third pinch roller pair 50 is switched to a nipped state. In this way, the decurling unit 2 is restored to a normal state providing decurling force, and resumes printing operations.

Incidentally, upon printing of the sheet S being continuously performed, with consumption of the sheet S, the roll outer diameter (radius) of the roll R1 or R2 set to the sheet feeding unit 1 is reduced. The smaller the roll radius is, the greater the curling of the sheet at this portion is. That is to say, decurling force to be corrected becomes great in accordance with consumption of the sheet S. Also, decurling force to be used differs depending on the type of sheet (such as stiffness). Therefore, the decurling unit 2 has a mechanism for adjusting decurling force to be provided to the sheet, and can provide appropriate decurling force according to the remaining amount of the sheet (curled state).

Figure 16:
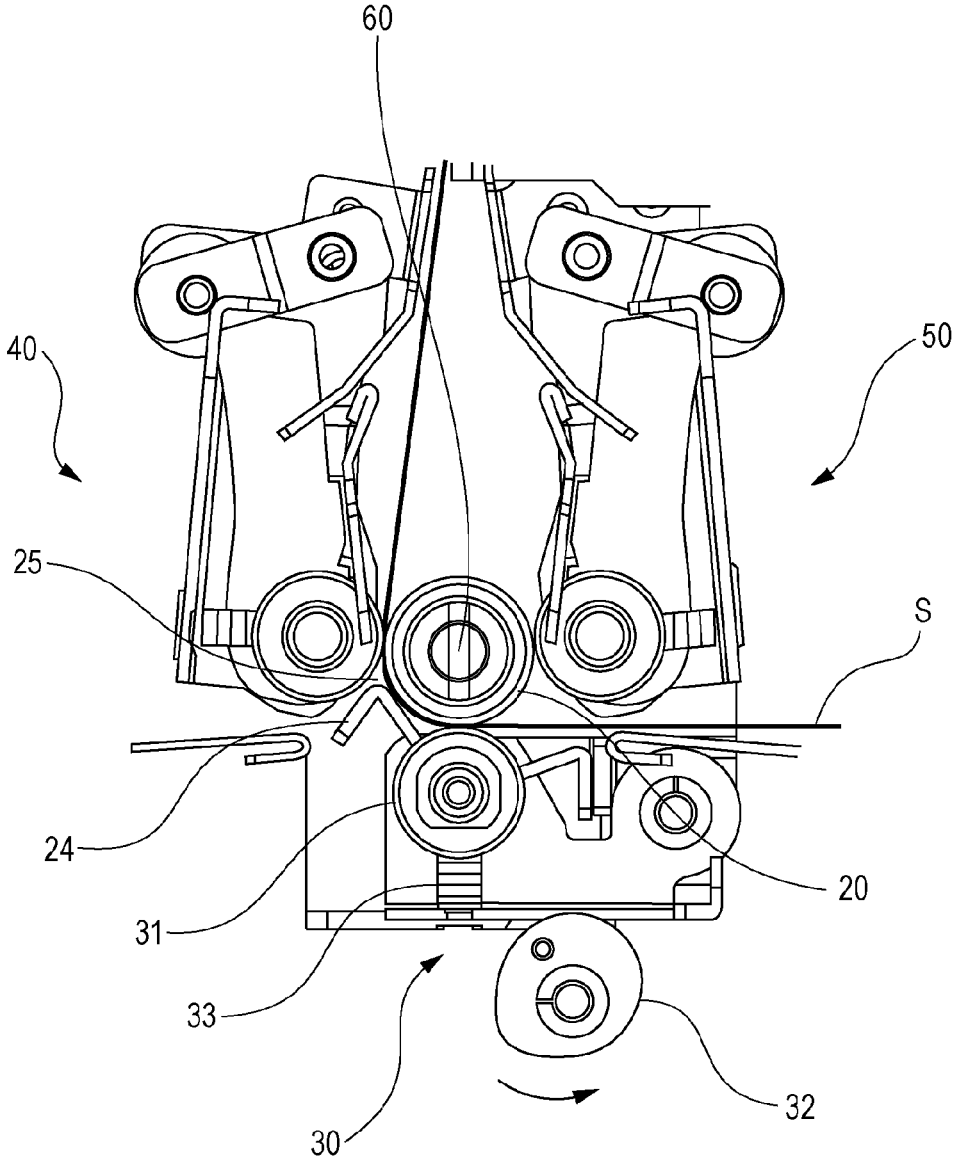
FIG. 16 is a diagram illustrating the configuration of a decurling force adjustment mechanism.

FIG. 16 is a configuration diagram of a decurling force adjustment mechanism in the decurling roller 20. The adjustment mechanism has two types of adjustment units. The first adjustment unit is a pressing mechanism including the cam 32 and pressing spring 33. Pressing force against the decurling roller 20 of the first pinch roller 31 by the pressing spring 33 is changed in a consecutive or stepwise manner, and the nip force of the first decurling roller pair 30 is changed. The greater the nip force is, the greater the winding amount of the sheet S as to the decurling roller 20 to overcome the sheet stiffness thereof, and accordingly, decurling force becomes great.

The second adjustment unit is a temperature adjustment mechanism made up of a heater 60 embedded within the decurling roller 20. Upon the roller surface temperature of the decurling roller 20 being increased by the heater 60, decurling force as to the sheet to come into contact with increases. The higher the temperature is, the greater decurling force is. Accordingly, decurling force can be changed by adjusting the heating value of the heater 60.

In the above step S19 and step S29, the above two adjustment mechanisms are controlled according to information relating to the remaining amount of the sheet wound around the roll R1 (R2) in the sheet feeding unit 1, or the winding rotary member of the reverse unit 9, and/or information relating to the type of sheet. Adjustment is performed so as to increase decurling force by controlling the nip force of the first decurling roller pair 30 to be increased, and also at the same time the temperature of the heater 60 to be increased, according to reduction in the remaining amount of the roll. In order to obtain the remaining amount of the roll, the remaining amount of the roll is estimated by subtracting the amount of reduction in roll diameter equivalent to consumed sheet length (the number of sheets or empty feeding amount of consecutive printing) from the initial roll diameter. Alternatively, an arrangement may be made wherein a dedicated sensor is provided, and the roll is directly detected to obtain information relating to the remaining roll diameter. Alternatively, an arrangement may be made wherein a sensor for directly measuring the curled state of a sheet is provided, and decurling force to be used is more directly obtained. The type of sheet is obtained from information set by the user at the operation unit 15.

Note that some types of sheet to be used require no decurling operation. In this case, steps S14 through S18 and steps S24 through S28 in FIG. 4 should be skipped.

Figure 17:
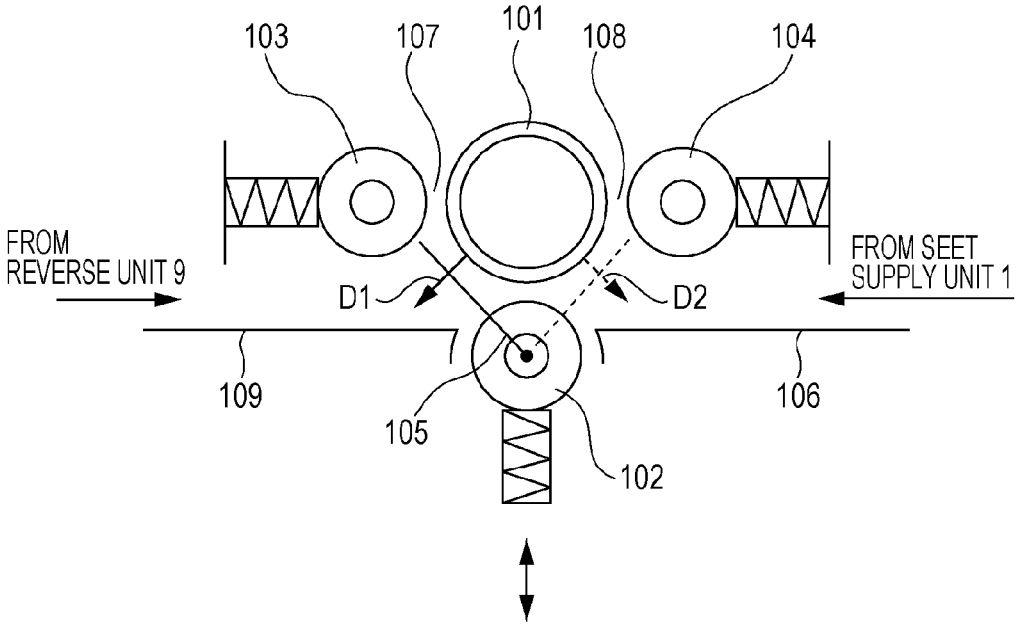
FIG. 17 is a conceptual diagram illustrating the configuration of a modification of the decurling unit.

FIG. 17 is a conceptual view illustrating the configuration of a modification of the decurling unit 2. With the configuration in FIG. 16, the decurling roller 20 is fixed, and the pinch rollers (first pinch roller 31, second pinch roller 41, and third pinch roller 51) move, and thus, contact and separation of each roller pair is performed. On the other hand, in FIG. 17, the same function is realized by the decurling roller side moving.

In FIG. 17, the decurling roller 101 is selectively movable in two directions (D1, D2) indicated with an arrow in the drawing using a driving mechanism. A switcher 105 for switching the path of a sheet is switched between a position indicated with a solid line and a position indicated with a dashed line in the drawing. With front face printing, a decurling roller 101 moves in the D1 direction. The decurling roller 101 and a first pinch roller 102 (first decurling roller pair) are brought into contact to a nipped state, and also the decurling roller 101 and a second pinch roller 103 (second decurling roller pair) are brought into contact to a nipped state. At the same time, the switcher 105 enters a position indicated with a solid line. With front face printing, the sheet is led in from the sheet feeding unit 1 along a guide 106, the first decurling roller pair and the second decurling roller pair are nipped, and including feeding back operation as described above, whereby decurling force is provided to the sheet.

On the other hand, with back face printing, the decurling roller 101 moves in the D2 direction. The decurling roller 101 and the first pinch roller 102 (first decurling roller pair) are brought into contact to a nipped state, and also the decurling roller 101 and a third pinch roller 104 (third decurling roller pair) are brought into contact to a nipped state. At the same time, the switcher 105 enters a position indicated with a dashed line. With back face printing, the sheet is led in from the reverse unit 9 along a guide 109, the first decurling roller pair and the third decurling roller pair are nipped, and including feeding back operation as described above, whereby decurling force is provided to the sheet.

With the above-mentioned embodiment, the sheet feeding unit 1 is regarded as the first sheet feeding unit, and the reverse unit 9 is regarded as the second sheet feeding unit, and appropriate decurling operation is performed as to a sheet to be fed from either at the common decurling unit 2. A printing apparatus is realized, which includes a compact decurling mechanism and enables two curl corrections with duplex printing. Thus, high-quality duplex printing can be performed. In addition, in the event that conveyance of a sheet is stopped during curl correction, the nipped state between the decurling roller and at least a part of the pinch rollers is disengaged, and influence of decurling force is alleviated. Therefore, the sheet is prevented from being provided with bending which locally remains.

Note that the present invention is not restricted to this, and may be applied to a system wherein, assuming that the reverse unit 9 feeds an unused roll R3, an unused sheet is fed from either of the roll R1 (or R2) and the roll R3 to print a simplex face.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-042342 filed Feb. 26, 2010 and No. 2010-111537 filed May 13, 2010, which is are hereby incorporated by reference herein in its their entirety.

What is claimed is:

1. An apparatus capable of duplex printing, the apparatus comprising:

a control unit configured to control sheet transport;

a sheet feeding unit configured to hold and feed a sheet wound in a rolled state;

a decurling unit configured to correct curling of the sheet fed;

a print unit configured to print on the sheet passed through the decurling unit; and a reverse unit configured to reverse the sheet printed by the print unit, wherein the decurling unit includes:

a decurling roller, a first pinch roller, and second and third pinch rollers on both sides of the first pinch roller, which are each disposed around the decurling roller, and are capable of forming a nipped state with the decurling roller, a first path configured to lead the sheet fed from the sheet feeding unit into a nip position between the first pinch roller and the decurling roller from a first direction, and the control unit performs so that the sheet in the first path is nipped with the decurling roller in order of the first pinch roller and the second pinch roller, and is fed to the print unit, and a second path configured to lead the sheet fed from the reverse unit into a nip position between the first pinch roller and the decurling roller from a second direction opposite to the first direction, and the control unit performs so that the sheet in the second path is nipped with the decurling roller in order of the first pinch roller and the third pinch roller, and is fed to the print unit.

2. The apparatus according to claim 1, wherein in the duplex printing, the control unit performs so that the sheet fed out from the sheet feeding unit is decurled at the decurling unit, a first surface of the sheet is subjected to printing at the print unit, the sheet is wound by the reverse unit, the sheet fed out from the reverse unit is decurled at the decurling unit again, and a second surface of the back of the first surface is subjected to printing at the print unit.

3. The apparatus according to claim 2, wherein the reverse unit includes a winding rotary member configured to wind a sheet around, wherein, with the duplex printing, the control unit performs so that the sheet of which the first surface is printed is temporarily wound around the winding rotary member, and subsequently, the winding rotary member is rotated in reverse, and the sheet temporarily wound around is led into the decurling unit from the second direction.

4. The apparatus according to claim 1, further comprising:

a switcher configured to switch a path, wherein at a time of a sheet being fed from the sheet feeding unit, the control unit performs so that the switcher enters a sheet conveying path on an opposite side of the sheet feeding unit as to the nipped position to change an advancing direction of the sheet, and at a time of a sheet being fed from the reverse unit, the control unit performs so that the switcher enters the sheet conveying path on an opposite side of the reverse unit as to the nipped position to change the advancing direction of the sheet.

5. The apparatus according to claim 4, further comprising:

a discharge roller pair configured to nip a sheet and the control unit performs so that the discharge roller pair feeds the sheet out to the print unit.

6. The apparatus according to claim 5, wherein the control unit performs so that the sheet fed from the sheet feeding unit is fed out in a forward direction in a state separated from the second pinch roller, passes through between the second pinch roller and the decurling roller, and at a time of a leading edge of the sheet being nipped with the discharge roller, the second pinch roller is switched to a nipped state, the sheet is fed back until the leading edge of the sheet is pulled out from the nipped position between the first pinch roller and the decurling roller, and then the sheet is fed out in the forward direction again, and wherein the control unit performs so that the sheet fed from the reverse unit is fed out in the forward direction in a state separated from the third pinch roller, passes through between the third pinch roller and the decurling roller, and at a time of the leading edge of the sheet being nipped with the discharge roller, the third pinch roller is switched to a nipped state, the sheet is fed back until the leading edge of the sheet is pulled out from the nipped position between the first pinch roller and the decurling roller, and then the sheet is fed out in the forward direction again.

7. The apparatus according to claim 1, further comprising: an adjustment mechanism configured to be controlled by the control unit to adjust decurling force to be applied to a sheet by the decurling roller.

8. The apparatus according to claim 7, wherein the adjustment mechanism includes a mechanism configured to be controlled by the control unit to change force for pressing the first pinch roller against the decurling roller.

9. The apparatus according to claim 7, wherein the adjustment mechanism includes a heater, wherein the heater is embedded in the decurling roller and is configured to be controlled by the control unit to enable roller surface temperature to be changed.

10. The apparatus according to claim 7, further comprising:

a unit configured to obtain information relating to a remaining amount of a sheet wound in a rolled state, or information relating to a type of the sheet, wherein decurling force is adjusted by the adjustment mechanism based on the obtained information.

11. The apparatus according to claim 1, wherein during curl correction of the sheet fed out from the sheet feeding unit, in an event that the conveyance of the sheet is stopped for longer time than a predetermined period, the control unit performs so as to disengage the nipped state between the decurling roller and the second pinch roller, and wherein during curl correction of the sheet fed out from the reverse unit, in the event that the conveyance of the sheet is stopped for longer time than a predetermined period, the control unit performs so as to disengage the nipped state between the decurling roller and the third pinch roller.

12. The apparatus according to claim 11, wherein the control unit performs so as to disengage the nipped state between the decurling roller and the first pinch roller in an event that the conveyance of the sheet is stopped during curl correction.

13. The apparatus according to claim 12, wherein the control unit performs so as to disengage the nipped state between the decurling roller and the first pinch roller and the third pinch roller in an event that the conveyance of the sheet is stopped during curl correction regarding whether the nipped state between the decurling roller and the first pinch roller is disengaged according to a type of the sheet to be used.

14. The apparatus according to claim 11, wherein the decurling unit includes:

a first lead-in roller pair configured to lead the sheet fed from the sheet feeding unit into the nipped position between the decurling roller and the first pinch roller, a second lead-in roller pair configured to lead the sheet fed from the reverse unit into the nipped position between the decurling roller and the first pinch roller, and a discharge roller pair configured to nip a sheet and to feed out to the print unit.

15. The apparatus according to claim 14, wherein the control unit controls the decurling unit at a time of the conveyance of the sheet being stopped during curl correction of the sheet fed from the feed unit so that driving of the discharge roller is stopped first, and subsequently, the nip between the second pinch roller and the decurling roller is disengaged and also driving of the first lead-in roller is stopped, and wherein the control unit controls the decurling unit at a time of the conveyance of the sheet being stopped during curl correction of the sheet fed from the reverse unit so that driving of the discharge roller is stopped first, and subsequently, the nip between the third pinch roller and the decurling roller is disengaged and also driving of the second lead-in roller is stopped.

16. The apparatus according to claim 15, wherein the control unit controls the decurling unit at a time of resuming the conveyance of a sheet of which the conveyance is stopped during curl correction so that driving of the discharge roller is first started, and subsequently, driving of the first lead-in roller is started and also the second pinch roller and the decurling roller are switched to a nipped state, or driving of the second lead-in roller is started and also the third pinch roller and the decurling roller are switched to a nipped state.

17. An apparatus configured to subject a sheet to processing, the apparatus comprising:

a control unit configured to control sheet transport;

a first sheet feeding unit and a second sheet feeding unit, each of which holds a sheet wound in a rolled state;

a sheet processing unit; and a decurling unit configured to decurl the sheet to be fed from one of the first sheet feeding unit and the second sheet feeding unit to feed out to the sheet processing unit, wherein the decurling unit includes:

a decurling roller, and a first pinch roller, and second and third pinch rollers on both sides of the first pinch roller, which are each disposed around the decurling roller, and are capable of forming a nipped state with the decurling roller, a first path configured to lead the sheet fed from the first sheet feeding unit into a nipped position between the first pinch roller and the decurling roller from a first direction, and the control unit performs so that the sheet in the first path is nipped with the decurling roller in order of the first pinch roller and the second pinch roller, and is fed to the sheet processing unit, and a second path configured to lead the sheet fed from the second sheet feeding unit into a nipped position between the first pinch roller and the decurling roller from a second direction opposite to the first direction, and the control unit performs so that the sheet in the second path is nipped with the decurling roller in order of the first pinch roller and the third pinch roller, and is fed to the sheet processing unit.

18. The apparatus according to claim 17, further comprising:

a switcher configured to switch a path, wherein, at a time of a sheet being fed from the first sheet feeding unit, the control unit performs so that the switcher enters a sheet conveying path on an opposite side of the first sheet feeding unit as to the nipped position to change an advancing direction of the sheet, and at a time of a sheet being fed from the second sheet feeding unit, the control unit performs so that the switcher enters the sheet conveying path on an opposite side of the second sheet feeding unit as to the nipped position to change the advancing direction of the sheet.

19. The apparatus according to claim 18, further comprising:

a discharge roller pair configured to nip a sheet and to be controlled by the control unit to feed out the sheet to the sheet processing unit.

20. The apparatus according to claim 17, wherein the sheet fed from the first sheet feeding unit follows around the decurling roller at least from the first pinch roller to the second pinch roller to be decurled, and the sheet fed from the second sheet feeding unit follows around the decurling roller at least from the first pinch roller to the third pinch roller to be decurled.

21. The apparatus according to claim 20, wherein the first sheet feeding unit unwinds the sheet such that a leading edge of the sheet has a curl in a direction separating from a surface of the decurling roller, and the second sheet feeding unit unwinds the sheet such that a leading edge of the sheet has a curl in a direction separating from the surface of the decurling roller.

* * * * *